US006492957B2

(12) United States Patent
Carillo, Jr. et al.

(10) Patent No.: US 6,492,957 B2
(45) Date of Patent: Dec. 10, 2002

(54) CLOSE-PROXIMITY RADIATION DETECTION DEVICE FOR DETERMINING RADIATION SHIELDING DEVICE EFFECTIVENESS AND A METHOD THEREFOR

(76) Inventors: Juan C. Carillo, Jr., 4036 W. 184 St., Torrance, CA (US) 90504; James S. Carillo, 4036 W. 184 St., Torrance, CA (US) 90504

( * ) Notice: Subject to any disclaimer, the term of this patent is extended or adjusted under 35 U.S.C. 154(b) by 0 days.

(21) Appl. No.: 09/740,071

(22) Filed: Dec. 18, 2000

(65) Prior Publication Data

US 2002/0075189 A1 Jun. 20, 2002

(51) Int. Cl.[7] ..... H01Q 1/24

(52) U.S. Cl. ..... 343/841; 343/703; 343/795; 250/336.1; 250/366; 324/95

(58) Field of Search ..... 343/703, 700 MS, 343/725, 795, 841; 250/336.1, 366, 367, 374; 324/95, 119

(56) References Cited

U.S. PATENT DOCUMENTS

| | | | | | |
|---|---|---|---|---|---|
| 3,641,439 | A | | 2/1972 | Aslan | 343/703 |
| 3,721,900 | A | * | 3/1973 | Andrews | 324/95 |
| 3,931,573 | A | | 1/1976 | Hopfer | 324/106 |
| 4,172,226 | A | * | 10/1979 | Rubin | 250/312 |
| 4,301,367 | A | | 11/1981 | Hsu | 250/370 |
| 4,518,912 | A | | 5/1985 | Aslan | 324/95 |
| 4,752,730 | A | * | 6/1988 | Aslan | 324/95 |
| 4,965,606 | A | * | 10/1990 | Merkel | 343/703 |
| 5,168,265 | A | | 12/1992 | Aslan | 340/600 |
| 5,373,284 | A | | 12/1994 | Aslan | 340/600 |
| 5,373,285 | A | | 12/1994 | Aslan | 340/600 |
| 5,600,307 | A | | 2/1997 | Aslan | 340/600 |
| 6,084,551 | A | * | 7/2000 | Aslan | 343/725 |
| 6,330,468 | B1 | * | 12/2001 | Scharf | 600/476 |

* cited by examiner

*Primary Examiner*—Tho Phan
(74) *Attorney, Agent, or Firm*—Charles C.H. Wu; Wu & Cheung, LLP

(57) ABSTRACT

A radiation detection device for locally detecting radiation of RF energy emissions from close proximity direct line-of-sight electromagnetic fields emitted by a wireless transmit/receive electronic equipment antenna 22 or body 21 such as a cellular telephone, in miniature/planar design form with suitable embedding form-factoring fashioned arrangement capability joined with radiation shielding devices. Said radiation detection device operates without prerequisite need for a battery or external power source, operationally self-powered by the embodiments of this invention when exposed to electromagnetic field radiation of predetermined thresholding energy level setting for the user's own personal alerting verification and assessment means of suitable predetermined radiation detection measurement tester coupling to radiation shielding devices to encompass an overall shield effectiveness system solution in real-time monitoring response fashion operation.

29 Claims, 19 Drawing Sheets

CLOSE-PROXIMITY RADIATION DETECTION DEVICE FOR DETERMINING RADIATION SHIELDING DEVICE EFFECTIVENESS AND A METHOD THEREFOR

BACKGROUND OF THE INVENTION

1. Field of the Invention

This invention relates generally to radiation detection devices for the presence of electromagnetic field (EMF), or radio frequency (RF), or microwaves, and more particularly, to radiation detection devices joined or operating in complementary suitable fashion with radiation shielding devices designed to reduce EMF radiating exposure to predetermined sensitive local human body tissue parts from potential harmful electromagnetic field energy levels emanating from close proximity direct line-of-sight wireless transmit/receive electronic equipment antenna or equipment body source, including wearable electronic equipment devices.

2. Discussion of Related Art

There is much concern throughout the world that radiation from electromagnetic field and microwaves may cause human body tissue damage. The antenna and the body of wireless transmit/receive electronic equipment such as a cellular telephone and higher frequency band transceivers come in close contact with a person head or sensitive human body tissue part thereby creating a close exposure to electromagnetic field and microwave radiation. Because of these hazards and to offer some protection against these hazards, some form of personal radiation shielding arrangement devices were invented.

As the proliferation of radiation shielding arrangement devices for wireless transmit/receive electronic equipment products make their way onto the marketplace. The assessing consideration of EMF verification and perceptible presence in measurable degree to which radiation shielding or blocking performances are determined by measured and evaluated purposes for user's of wireless electronic equipment to quantifiably determine potential presence of EMF radiating exposure levels is lacking. This measure of EMF radiation with respect to radiation shielding arrangement device shielding performances is a necessary parameter specification as part of the overall shield effectiveness system solution for the user's own personal assessment of radiation shielding arrangement device operational capability, reliability and the relative radiation safety figure-of-merit value that is provided in a real-time response evaluating fashion. Whereby said relative radiation safety figure-of-merit value is comprised of the method of shielding effectiveness figure-of-merit measure.

Existing prior art designs provide unsuitably large shape and complex accessories comprising of an abundance of assembly electronic piece parts as referred to personal electromagnetic radiation monitor devices that will afford radiation detection of EMF radiating sources propagating in direct line-of-sight. The prior art devices are adhoc design integrating combination to operate with radiation shielding arrangement devices. They constitute an incompatible design not suitable when taking into consideration form, fit, and function with the objective of providing the user with unhindered protective alerting detection means from exposure to EMF radiating sources. Or, to provide a user with a real-time radiation detection means. Other prior forms of radiation detection devices are dosimeters and densitometers. Both of which are bulky and are not portable or practical. Said prior art designs are generally not suitable for the type of radiation detection arrangement prescribed by this invention because by integrating said prior art designs with radiation shielding arrangement devices, their intended combined adhoc design integrating fashion utility would greatly alter the particular radiation shielding arrangement device design form-factor for any suitable practical use.

Therefore, there is a need for a radiation detection device that is simple, employing lightweight construction materials and without the need for a power source.

SUMMARY OF THE INVENTION

In accordance with the teaching of the present invention, a radiation detection device that is simple and economic to manufacture for use in conjunction with a radiation shielding devices, without altering said radiation shielding device, is disclosed. Furthermore, this invention will provide means for determining the EMF radiating exposure level at close-proximity to the radiation shielding device located near the user's predetermined sensitive human body area for means of alerting and monitoring detection and coverage protection from EMF radiating source. The invention is comprised of a transducer arrangement means, in converting the free-space transmission of EMF energy originating from a EMF radiating source with EMF energy exposing and presently accepted by the invention signal receptor and transducing said EMF energy into a visible or audible or mechanical stimulation or electrical processing output as means for said EMF energy detection verification. The degree of exposed EMF energy at the user's predetermined measuring location is presently detected by the radiation detection device in a close-proximity to EMF radiating source is proportional to the transduced EMF energy outputted by an indicator arrangement as is comprised within the radiation detection device and thereby said transduced EMF energy outputted by said radiation detection device provides the user with a measuring means for evaluating the EMF radiating exposure level at the user's predetermined criterions.

The invention operates suitably over a wide range of frequencies of the electromagnetic spectrum. The predetermined frequency operational band selection is accomplished by tuning or fixing the antenna's specification and an appropriate crystal detector tuning impedance comprising its junction capacitance of less than or about two picofarads. The coupling to the invention with a radiation shielding device, enhances overall shield system solution for a user's need for determining the effectiveness of a radiation shielding device and its reliability in a continuously monitored real time mode.

Radiation shielding devices that would benefit from the addition of this invention are RF (radio frequency) shield wearable garments such as a hat, a RF shield eyewear, a RF shield wearable wrap-around articles, a RF shield electronic equipment carrying pouches or cases, a RF shield upwardly fan structure arrangement, a folded or fixed RF shield fan structure, a internally pop-up RF shield fan mechanism, and a RF shield screen structure arrangement. Said radiation shield devices may employ woven RF shielded article arrangements comprising of EMI/RFI (Electromagnetic Interference and Radio Frequency Interference) metallic conductive material weaved fabric and a non-woven RF shielded article arrangements comprising of EMI/RFI material properties sandwiched between a laminating processing layer and a EMI/RFI material property deposition layer composing of a metallic conductive nature, thereby forming hybrid fabrication constructions and processing arrangements and distinguishable apart from conventional article fabrication techniques.

The invention can be permanently attached or not permanently attached to a radiation shielding device. It can be attached via an adhesive contact, a sewn-on, a lining, a clip-on, a pocket inserting, a necklace forming arrangement, a jewelry forming arrangement, or a Velcro-attached arrangement, to said radiation shielding device.

There are two test modes for detecting radiation as relating to this invention in performing the method of shielding effectiveness figure-of-merit measure, is also referred to as the radiation detection verification methodology. The first test mode is performed with a predetermined electromagnetic field radiating source such as a cell phone with the cell phone antenna placed near a user's predetermined target of measuring interest location point as located on the perspective non-blocking side of the radiation shielding device as is adjacently located next to the radiation detection device with antenna arrangement exposed sideway, or in a alternatively described perspective as referenced from an obverse perspective view is referred to as the radiation shielding side surface, then said radiation detection device with an antenna exposed side is illuminated or activated with EMF energy from said EMF radiating source. Said radiation detection device subsequently activates the stimulus indicator at a predetermined energy threshold level setting and provides means of a measurable stimulus indicator behavior response such as a light output, either flashing or in steady-state. Said output method is not limited to light. Other output such as sound or a mechanical vibration function operation or electrical processing operation, as to indicate that EMF energy or power density has been sensed by the radiation detection device on the perspective non-blocking side of the radiation shielding device, is disclosed. Additionally, this procedural process provide a first relative reference calibration measuring means for the user to indicate normal and proper radiation detection operation, thereby also providing an EMF energy measurement takened as to simulate a reference level without shielding in place.

The second test mode is performed by illuminating the invention with an EMF energy radiating source from the blocking side of the radiation shielding device with respect to the radiation detection device located in the opposing illuminated side, of said radiation detection device diametrically located across the radiation shielding device illuminated side provides a measurable indication that EMF energy is blocked. It is shown by an inactivating stimulus indicator such as diminished light apparatus intensity level to no light intensity level or by an alternative stimulus indicator such as a diminished audible response to no audible response, or diminished mechanical vibrating response to no vibrating response, or diminished electrical processing output to no electrical processing output product, all to show that EMF energy or power density has been sensed by the radiation detection device on the perspective blocking side of the radiation shielding device, thereby also providing an EMF energy measurement takened with shielding in place. In the stated procedure thereof, this second test mode procedural process provide a second relative reference calibration measuring means for a user to indicate proper sensing of radiation detection device in shielding or blocking mode.

Another alternative embodiment of said relative reference calibration measuring means would be to introduce a stimulus indicator functioning mode of the invention to indicate a graduated level indicating response means that would provide the user a displayed means of detection or another sensory indicator means to provide perceptible presence in degrees of detected EMF energy intensity level variations measured as a function of varying the distance separated from the illuminating EMF energy source and the referenced radiation detection device.

A procedure of using a radiation detection device to provide a measure rating for the shielding or blocking effectiveness measure of energy radiated electromagnetic fields as shown by indicating EMF energy reducing fashion is referred to as the method of shielding effectiveness figure-of-merit measure. Said method of shielding effectiveness figure-of-merit measure, is in more simple discussion terms referred to as the method. Said method is stated by the decibel value rating comprising the ratio equating formula of electromagnetic field strength measurement takened before and after shielding is in place or measurement takened without and with shielding in place, as prescribed by said radiation detection verification methodology comprising of said first test mode and said second test mode. Whereby, said method give results in providing a protective radiation monitoring detection ratio value and displayed accordingly to the previously mentioned specification. Also recognized is, of said decibel value rating, an alternative formula expression to the decibel value rating specification may also be restated in magnitude value rating specification for ease of the user's shield effectiveness measure and interpretation. The method by which shielding effectiveness and radiation detection may be estimated is the transmission line method and circuit method, published by the IEEE, 1988 "Special issue on electromagnetic shielding", IEEE Transactions on EMC, EMC-30, No. 3, August.

A radiation detection device comprises a predetermined parameter set selection of tuned antenna arrangement, of tuned crystal detection arrangement and of tuned stimulus indicator arrangement. The tuned antenna arrangement parameters frequency response is optimized for a predetermined electric field energy pattern gain response over frequency and is designed to acceptingly receive a predetermined free-space path transmission signal EMF energy in direct line-of-sight transmission from a wireless transmit/receive electronic equipment antenna emission radiated energy or equipment body leakage emission radiated energy. Said energy is converted into RF electrical signal. Said RF (radio frequency) electrical signal is converted into monitoring DC voltage signal by a predetermined selection of tuned crystal detection arrangement parameters. Then said monitoring DC (direct current) voltage signal provide a predetermined excitation electrical signal level into the stimulus indicator arrangement to facilitate proper stimulus indicator operation by predetermined selection of stimulus indicator arrangement parameters.

Operation of the radiation detection device is self-powered with the exposure to predetermined EMF energy and converting this energy into monitoring DC voltage signal that is proportional to the radiated EMF energy exposure level. Said monitoring DC voltage signal operation is by simultaneous operating means, provide self-powered means to the stimulus indicator arrangement, in providing predetermined detection indicator response due to close-proximity exposure to direct line-of-sight propagation of EMF energy radiation from a wireless transmit/receive electronic equipment antenna EMF source or body EMF source or combined EMF source composition thereof.

Additional objects, advantages, and features of the present invention will become apparent from the following description and appended claims, taken in conjunction with the accompanying drawings.

DETAILED DESCRIPTION OF THE PREFERRED EMBODIMENTS

Figure 1:
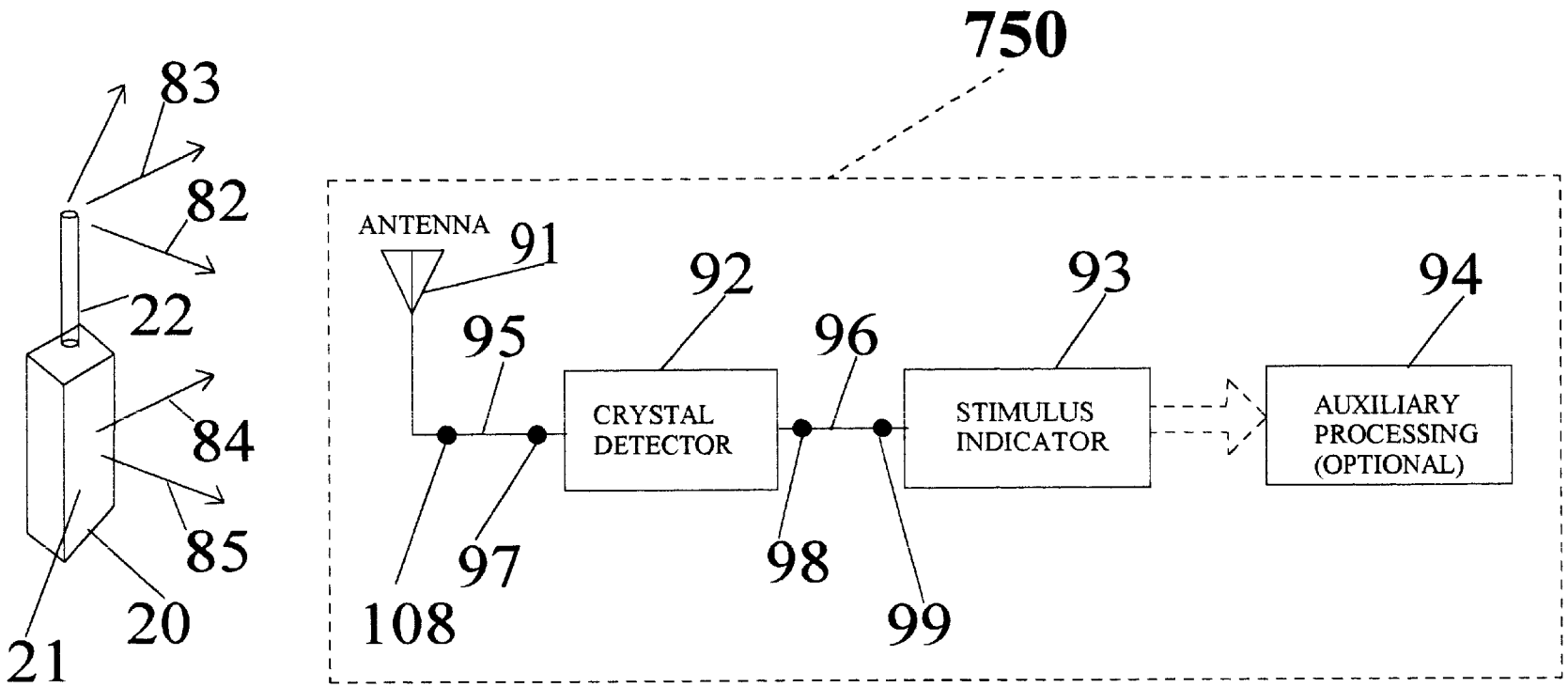
FIG. 1 is a functional block diagram of an exemplary radiation detection device according to the teachings of the present invention.

The following discussion of the preferred embodiments is directed to radiation detection device in lightweight thin miniature construction form employing economic manufacturing process having a capability of joining with radiation shielding devices, and without need for a power source. This invention provides a means for measuring of electromagnetic field (EMF) energy level at close-proximity to a user's body, or a means for measuring of leakage EMF energy at close-proximity to a radiation shielding device with radiation detection device employed in an embedding/non-embedding fashion, with said radiation detection device and in close-proximity exposure to a transmit/receive electronic equipment 20, comprising a body 21 and antenna 22 such as and not limited to a cell phone or wearable electronic equipment devices. Said radiation detection device is coupled together with said radiation shielding device employing EMI/RFI (Electromagnetic Interference and Radio Frequency Interference) material properties comprising metallic conductive and magnetic means with predetermined electrical parameter criterions comprising of RF skin depth specification and surface resistance specification as means for predetermined reflecting, deflecting, absorbing, and attenuating of electromagnetic field energy.

The radiation detection device in an embedding/non-embedding fashion means with a radiation shielding device configuration comprises a predetermined radiation detection device attachment configuration to the radiation shielding device either permanently attached to the radiation shielding device or optional not permanently attached to the radiation shielding device. Alternatively, as a adhesive contact attachment, or sewn-on attachment, or by liner attachment, or clip-on attachment, or pocket inserting device, or necklace forming arrangement, or jewelry forming arrangement, or Velcro-attached arrangement, having said radiation detection device joined to said radiation shielding device in a contiguous manner, thereby forming an integrated shield detection device. Where further discussion of said integrated shield detection device examples are presented by FIGS. 7 through 14, recognizing said integrated shield detection device is comprised of the subcomponents, a radiation detection means and radiation shielding means.

The radiation detection means of the invention is performed by a transducing means. It converts EMF energy radiation received through the free space from an EMF energy source and displays it into a visible or audible or mechanical or electrical processing product outputs.

Referring to FIGS. 1 through 6 are the main embodiments of the radiation detection device suitable for in a configuration of embedding/non-embedding fashion means with radiation shielding devices, is disclosed.

In FIG. 1 is a functional electrical circuit block arrangements diagram of an exemplary radiation detection device 750 comprising an antenna means 91, a first electrically conductive transmission means 95, a crystal detector means 92, a second electrically conductive transmission means 96, a stimulus indicator means 93 and an optional auxiliary signal processing means 94. Where said functional electrical circuit block arrangements are connected in predetermined serial electrical block node configuration or cascading block node configuration. The antenna means 91 receives EMF energy emanating from a wireless transmit/receive electronic equipment body 84, 85 or RF energy from a antenna energy radiating source 82, 83 and transforms the RF energy or EMF energy into RF electrical signal outputting at an antenna device output terminal port 108 that is connected electrically by means of a first electrical conductive transmission means 95 to the crystal detector means input terminal port 97. The crystal detector means 92 applies the square law characteristics in predetermined electrical converting means for monitoring relative power densities by accepting RF electrical signal at said crystal detector means input terminal port 97 and generating a converted monitoring DC voltage signal at said crystal detector means output terminal port 98. Said converted monitoring DC voltage signal is manageably to operate the stimulus indicator means 93 connected electrically through a second electrical conductive transmission means 96 and presented at the stimulus indicator means input terminal port 99. The stimulus indicator means 93 operates as a transducing means converting said monitoring DC voltage signal input into a verification device indicator means output form. Said verification device indicator means output is comprised of a means for a measurable stimulus indicator outputting form such as and not limited to a light sourcing indicator, or light sourcing indicator with offset bias circuit adjust, or audible sourcing indicator, or vibration sourcing indicator, or analog metering means, or digital metering means, or electrical processing product indicator suitable for additional optional auxiliary signal processing means 94 comprising either internal on-board or external off-board digital signal processor circuit operating fashion hookup means regarding this invention.

An alternative embodiment of said internal on-board or external off-board digital signal processor circuit operating fashion hookup means for optional auxiliary signal processing means 94, comprises of means for shared self powered operation under predetermined EMF energy source illumination of said radiation detection device for the purpose of providing predetermined self-powering operation hookup of digital signal processor circuits comprising of smart card device arrangements, or bio-electronic device arrangements, or Bluetooth technology product. Said configuration eliminates the need for an on-board power supply. Said configuration accepts off-board external power source, to accept transmission of command, data and smart card devices along with the microprocessor and memory embedded into the smart card device; or to applicably interface hookup with a bio-electronic device comprising of ELF energy and of bio-feedback processing means; or to applicably interface hookup with Bluetooth technology comprising short-range radio hookup means.

Alternatively, said radiation detection device comprises: antenna means 91, comprising a dipole antenna, linear antenna, a wire antenna, coil loop antenna, planar substrate patch antenna, multiple-quarter wavelength antenna, Yagi type antenna, reflector arrangement antenna, array feed antenna; crystal detector means 92 comprising a diode rectifier, a fast switching Schottky diode, a transistor device, a three terminal or multiple terminal semiconductor device; a stimulus indicator means 93, comprising an optical transducer such as and not limited to a light emitting diode (LED), an audible transducer, mechanical vibrating transducer, analog metering transducer, digital metering transducer, electrical signal processing product transducer; optional auxiliary signal processing means 94, comprising digital signal processor circuits; and electrically conductive transmission means 95, 96, comprising a lumped element circuit line, a distributed tuned element transmission line, and a hybrid circuit transmission line combination, thereof. Another alternative embodiment of this invention employs component size reduction and flexible layout fashion arrangement comprises the implementation and advantages of hybrid monolithic integrated circuit technology arrangement. Various modifications of this invention will be apparent to those skilled in the art. For example, a specific bow-tie form dipole antenna of said dipole antenna 101 has been found suitable for the antenna means 91 due to the general circuit design convention in engineering such construction assembly form-factor arrangements 825 and 850. Where said dipole antenna comprising of a simple dipole antenna, a bow-tie shaped dipole antenna, a circular loop-shaped dipole antenna, square-shaped dipole antenna, and other polygon-shaped dipole antenna are suitable for said antenna means 91. Also recognized is, a antenna is long known in electronics, the theory of conventional antennas can be found in several reference books for example: Y. T. Lo and S. W. Lee (Editors), Antenna Handbook Theory Applications and Design, Van Nostrand and Reinhold Company, New York, 1988; and John D. Kraus, Antennas, McGraw-Hill Book Company, 1988.

Figure 2:
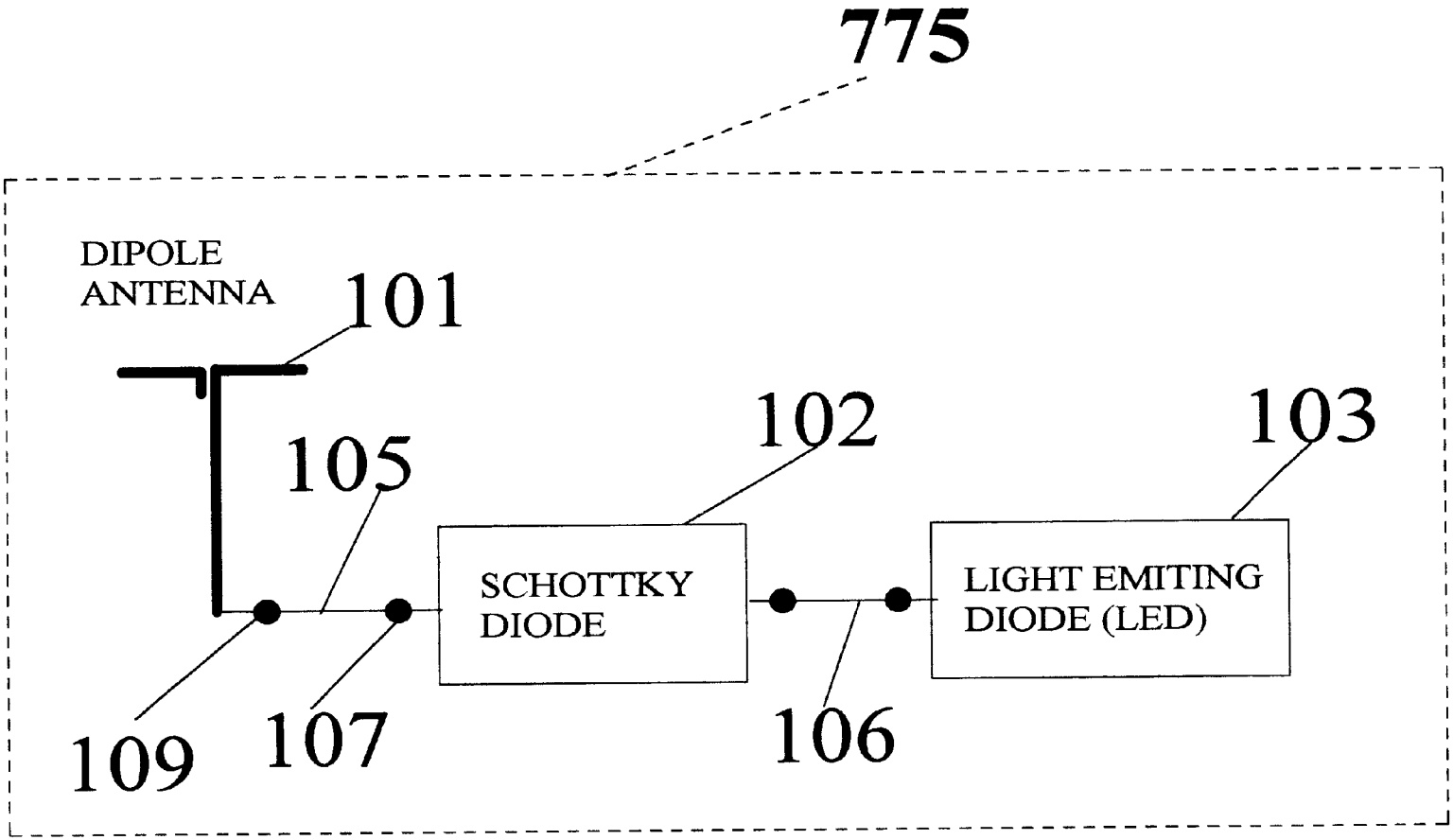
FIG. 2 is a block diagram of the preferred embodiment of a single-section radiation detection device block diagram comprising a simple dipole antenna, fast switching Schottky diode and light emitting diode (LED)

FIG. 2 is a functional electrical circuit block arrangements diagram of the preferred embodiment of a radiation detection device comprising a predetermined simple dipole antenna 101 to receive and provide measure of EMF energy signal frequency response of single EMF linear polarization, a first electrically conductive transmission means 105, fast switching Schottky diode 102, a second electrically conductive transmission means 106, and a LED 103, employing predetermined tuning to a prescribed frequency band. Also recognized is, tuning or impedance tuning is long known in RF and microwave electronics, the theory of conventional tuning can be found in several reference books, for example: Samuel Y. Liao, Microwave Devices and Circuits, Prentice-Hall, Inc., New Jersey, 1980; and John D. Kraus, Electromagnetics, McGraw-Hill Book Company, 1973.

Figure 3:
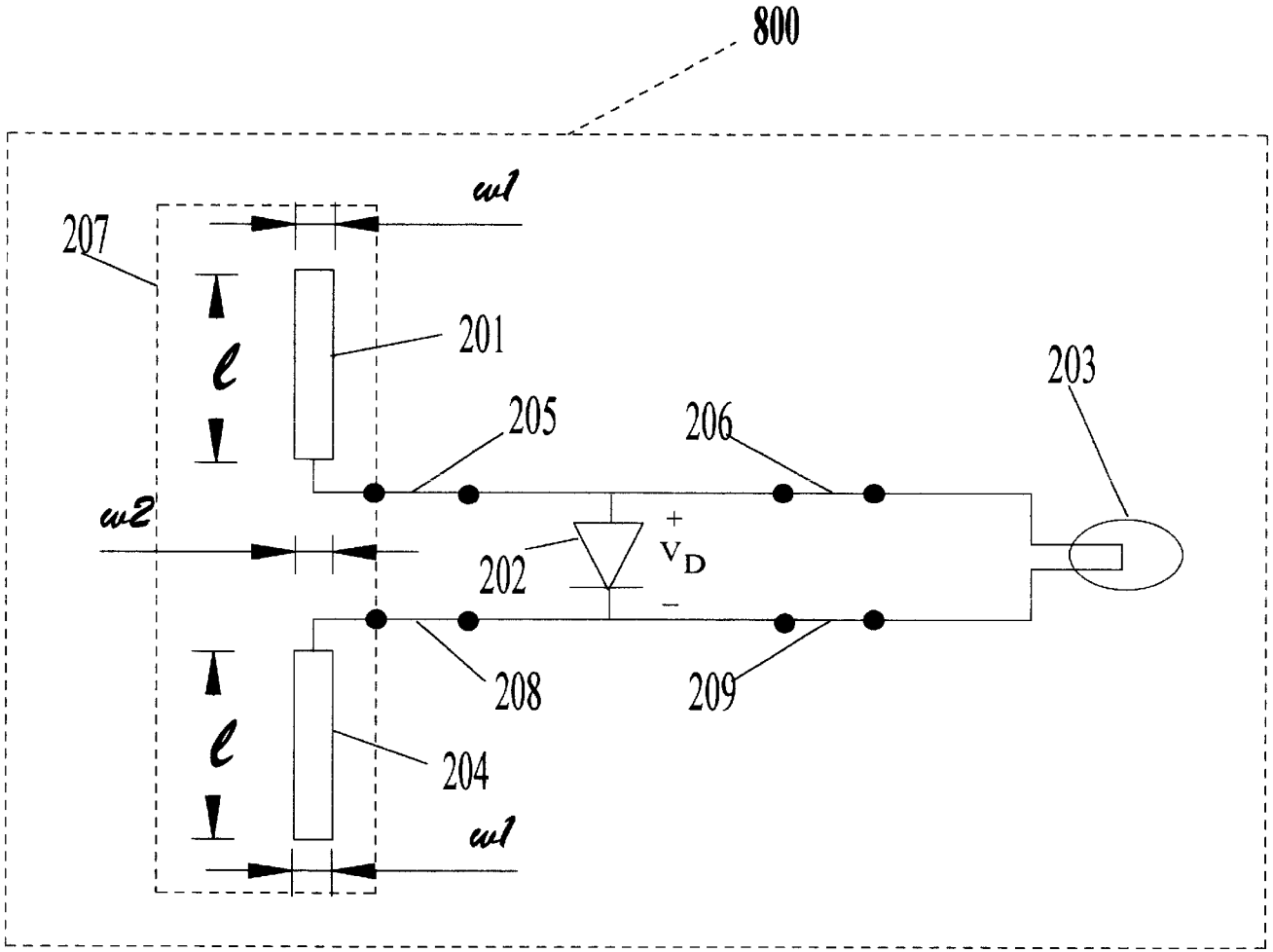
FIG. 3 is a single-section radiation detection device electrical schematic diagram of the preferred embodiment shown in FIG. 2.

In FIG. 3 is a single-section radiation detection device element 800 electrical schematic diagram or alternatively referred to as an element 800 of the preferred embodiment as shown a functional block diagram in FIG. 2. Said single-section radiation detection device or said element comprises a balancedly tuned dipole antenna 207 of predetermined conductive metallic strips 201, 204 of dipole arm member length l and dipole arm member widths w1,w2 with physical member length and member width dimensions predeterminedly tuned to receive and provide measure of EMF energy frequency response of single EMF linear polarization for conversion into RF electrical signal, a first pair of tuned electrically conductive transmission means 205, 208 interconnecting electrically said balancedly tuned dipole antenna 207 to said Schottky diode device 202, said Schottky diode device 202 electrical design parameters are predetermined by tuning criterions for RF electrical signal conversion into a monitoring DC voltage signal to electrically drive said light emitting diode (LED) 203 device parameters, said second pair of tuned electrically conductive transmission means 206, 209 interconnecting electrically said Schottky diode device 202 to said LED device 203, and said LED device 203 electrical design parameters are predetermined by tuning criterions to accept being electrically driven into operation by said Schottky diode device operation.

Figure 4A:
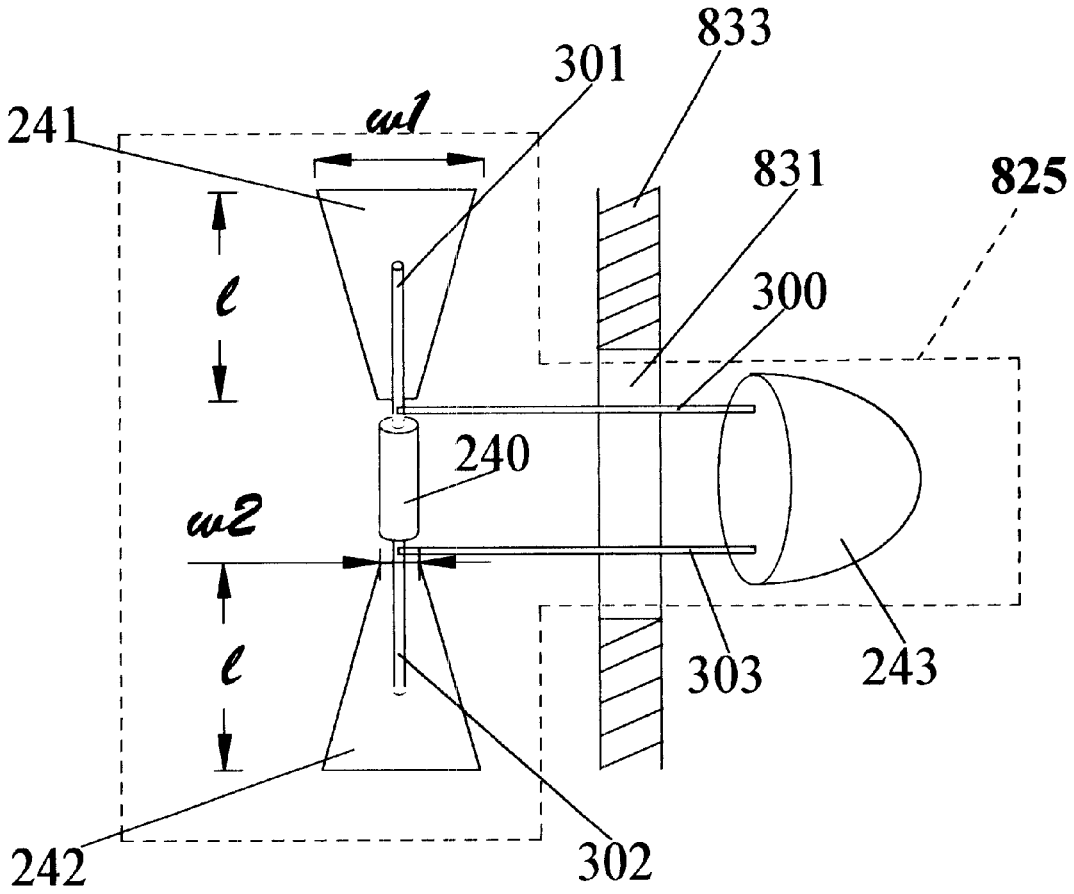
FIGS. 4*a,* 4*b,* and 4*c* depicts a general construction layout of the preferred embodiment of FIG. 3 depicting two variations of assembly layout configuration selection, in FIG. 4*a* is a feed-through construction attachment means and in FIG. 4*b* is a planar construction attachment means, including side profile view as shown in FIG. 4*c;*
Figure 4C:
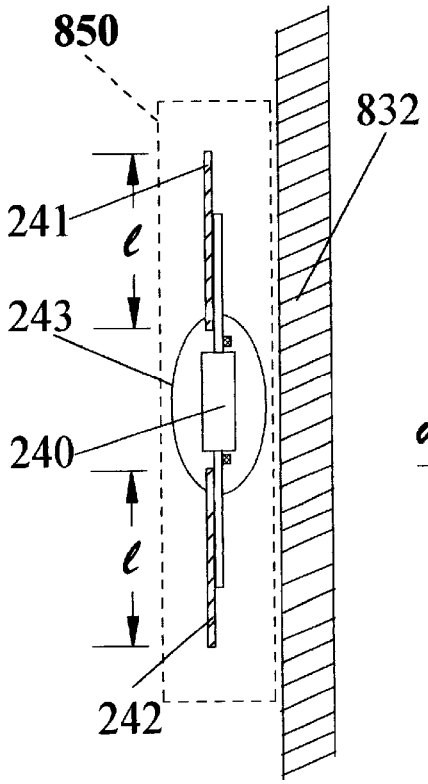
Figure 4B:
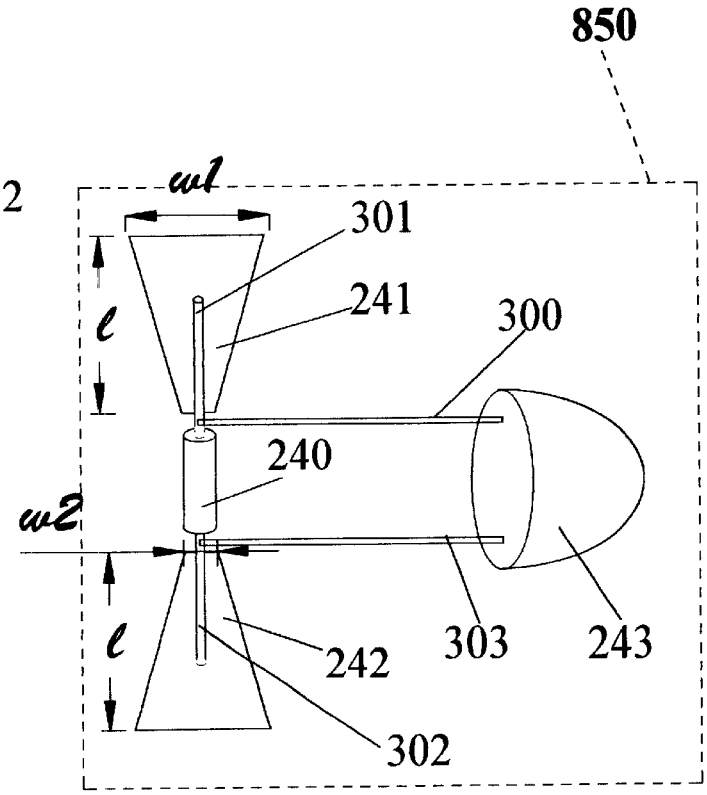

In FIG. 4 is a general construction layout of the preferred embodiment of the single-section radiation detection device element 800 comprising two alternative variations in joining a radiation detection device with a radiation shielding device. The first alternative variation as shown in FIG. 4*a,* a front view extruding single-section radiation detection device member is referred to a feed-through construction attachment means 825 approach with stimulus indicator means comprising an LED 243 part of the single-section radiation detection device 800 generally extruding out through a predeterminedly provided radiation shielding arrangement with feed-through access hole arrangement 831 as shown referenced to a radiation shielding arrangement cross-sectional cut view 833. The second alternative variation as shown in FIGS. 4*b,* 4*c* a front view and coplanar profile cut view respectively, is referred to a planar construction attachment means 850 approach with the single-section radiation detection device element 850 surface plane residing coplanar to the radiation shielding device surface plane as shown in cross-sectional cut view 832. It will be shown in further discussions of the preferred embodiment with reference to FIGS. 7 through 14, the two alternative radiation detection device variations of construction layout suitability in embedding/non-embedding fashion means as is joined with radiation shielding devices.

The radiation detection device configured in embedding/non-embedding fashion means comprises a predetermined radiation detection device in attachment configuration means joining with the radiation shielding device either permanently attached to the radiation shielding device or optional not permanently attached to the radiation shielding device. Said embedding/non-embedding fashion means provide means for ease of repeatable cycles of reliable removing process operation or reinstalling process operation of the radiation detection device from the radiation shielding device and thereby function as a fastening configuration means for the radiation detection device joining with radiation shielding device by a predetermined conventional process attachment selection comprising of adhesive contacting process, sewn-on attached, by liner attached, clip-on attachment, pocket inserting means, necklace forming arrangement, jewelry forming arrangement, and Velcro-attached arrangement, with said radiation detection device joined to said radiation shielding device in a general construction layout comprising a planar construction attachment means or a feed-through construction attachment means to aid the user's own personal verification of operational radiation detection verification measurement.

Said general construction layout 825, 850 comprises a predetermined pair of tuned thin tapered bow-tie shaped conductive metallic strip 241, 242 of length l and widths w1, w2 antenna, predeterminedly selected as another alternative embodiment to said balancedly tuned simple dipole antenna 207 with predetermined conductive metallic strips 201, 204 of fixed constant width w antenna. Said pair of thin tapered bow-tie shaped conductive metallic strip 241, 242 provides greater antenna EMF energy measuring efficiency and predeterminedly attached by electrically conductive structure supporting arrangement means to fast switching Schottky diode device conductive lead assembly terminal arrangement 301, 302 and LED device conductive lead assembly terminal arrangement 300, 303 is predeterminedly attached by electrically conductive structure supporting arrangement means to said fast switching Schottky diode device conductive lead assembly terminal arrangement 301, 302.

Figure 5A:
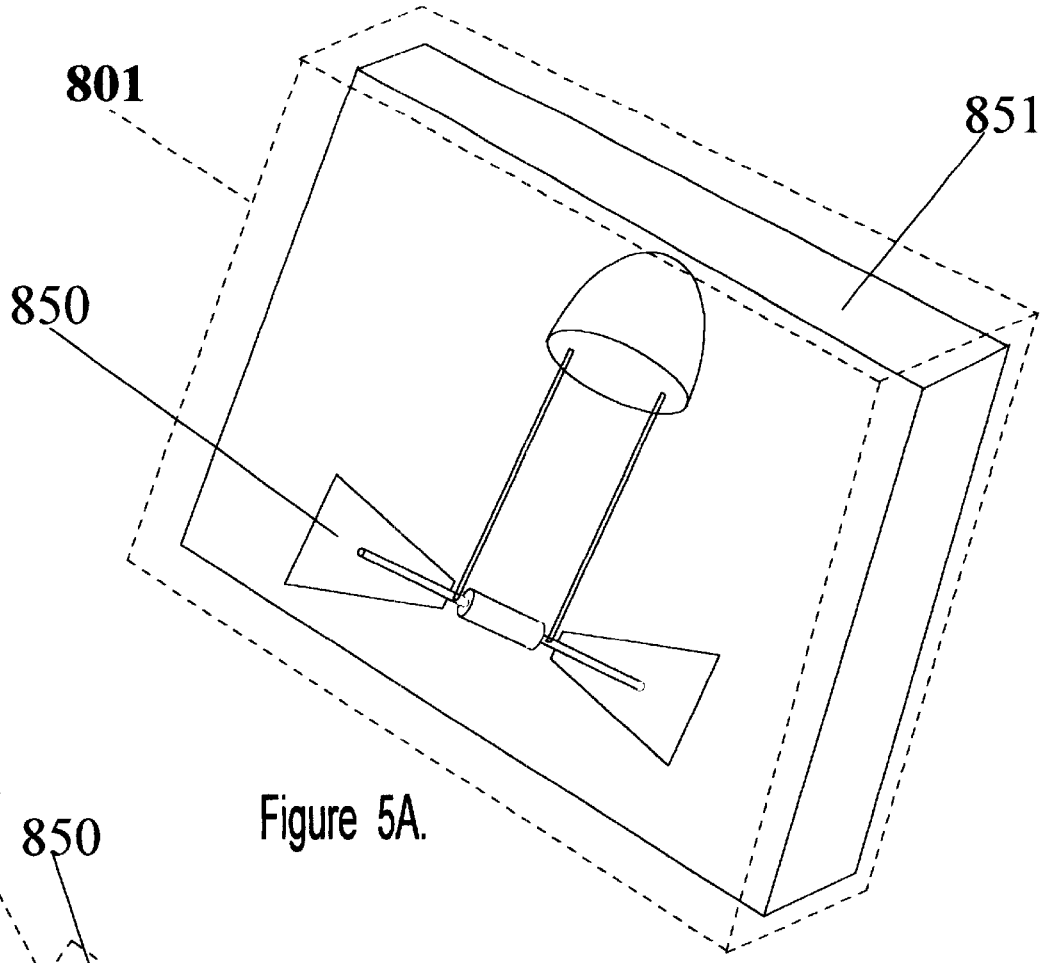
FIGS. 5*a* and 5*b* depicts a perspective view of the radiation detection device laminate-mounted in a electromagnetic transparent plastic credit-card-sized form and alternative form option which serves to provide the user with a predetermined single-section EMF detection sniffing probe arrangement for personal EMF energy presence indicator assessment use.

In another preferred embodiment of FIG. 4, is as shown in FIG. 5*a,* 5*b* is a perspective view and side view of an radiation detection device 850 encased in material forming arrangement in providing for greater outer structure supporting means to form a predetermined general shape encased radiation detection device 801. Said general shape encased radiation detection device comprises using planar construction attachment means 850 encased into predetermined suitable material forming outer supporting structure configuration which serves as means for expanding said embedding/non-embedding configuration into a general shape embedding/non-embedding configuration comprising such as and not limited to a thin planar plastic laminated credit-card-size radiation detection device 851. Said thin planar plastic laminated credit-card-size radiation detection device is specifically shaped into a credit card form as a means for greater non-embedding configuration accessibility such as for a remote-able RF sniffing probe option device. Said remote-able RF sniffing probe option device with predetermined calibration setting provides the user with un-shielded radiation detection device measurement capability for means of determining the presence of EMF energy radiated emission and for acquiring perceptible measuring threshold presence of predetermined EMF energy radiated emissions within close proximity of the unprotected or un-shielded surrounding environment.

Figure 5B:
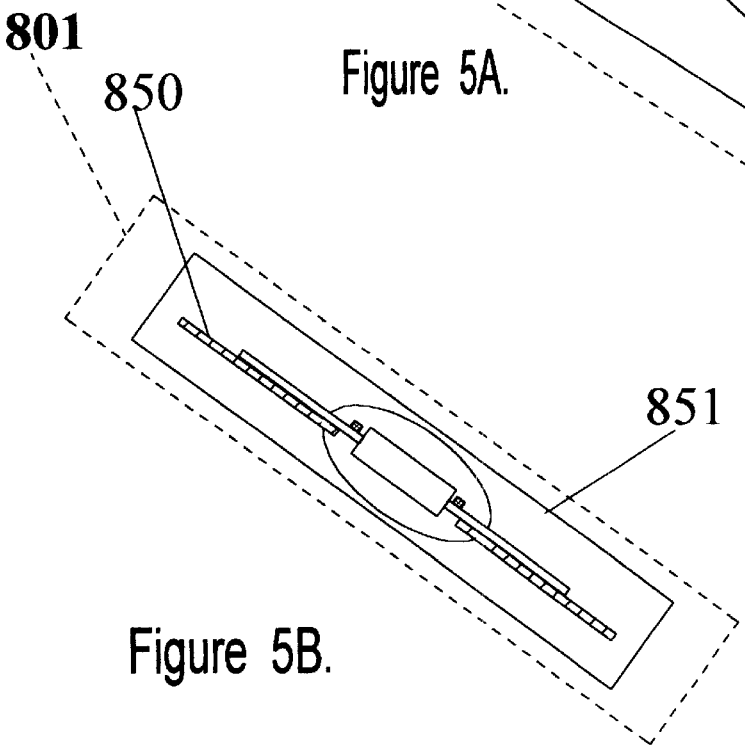

Stating another alternative embodiment of FIG. 5, said general shape encased radiation detection device 801 as disclosed for said general shape encased embedding/non-embedding configuration is alternatively suitable in predetermined plastic encased forms comprising of a thin sheet form, hand-held wand form, a patch-worned form by the user, a patch-placed form on the electronic equipment, used as in a pocket-inserting form, a shaped jewelry form, shaped necklace form, a shaped planar card form, shaped perforation form, shaped texture form, a shaped polygon form, a shaped cylindrical form, net-like webbing sheet form, a shaped miniature portable probing sniffer stick form.

Stating a second alternative embodiment of FIG. 5, alternative RF sniffing probe option devices comprises a predetermined set of alternative antenna means, alternative crystal detector means and alternative stimulus indicator means.

Figure 6:
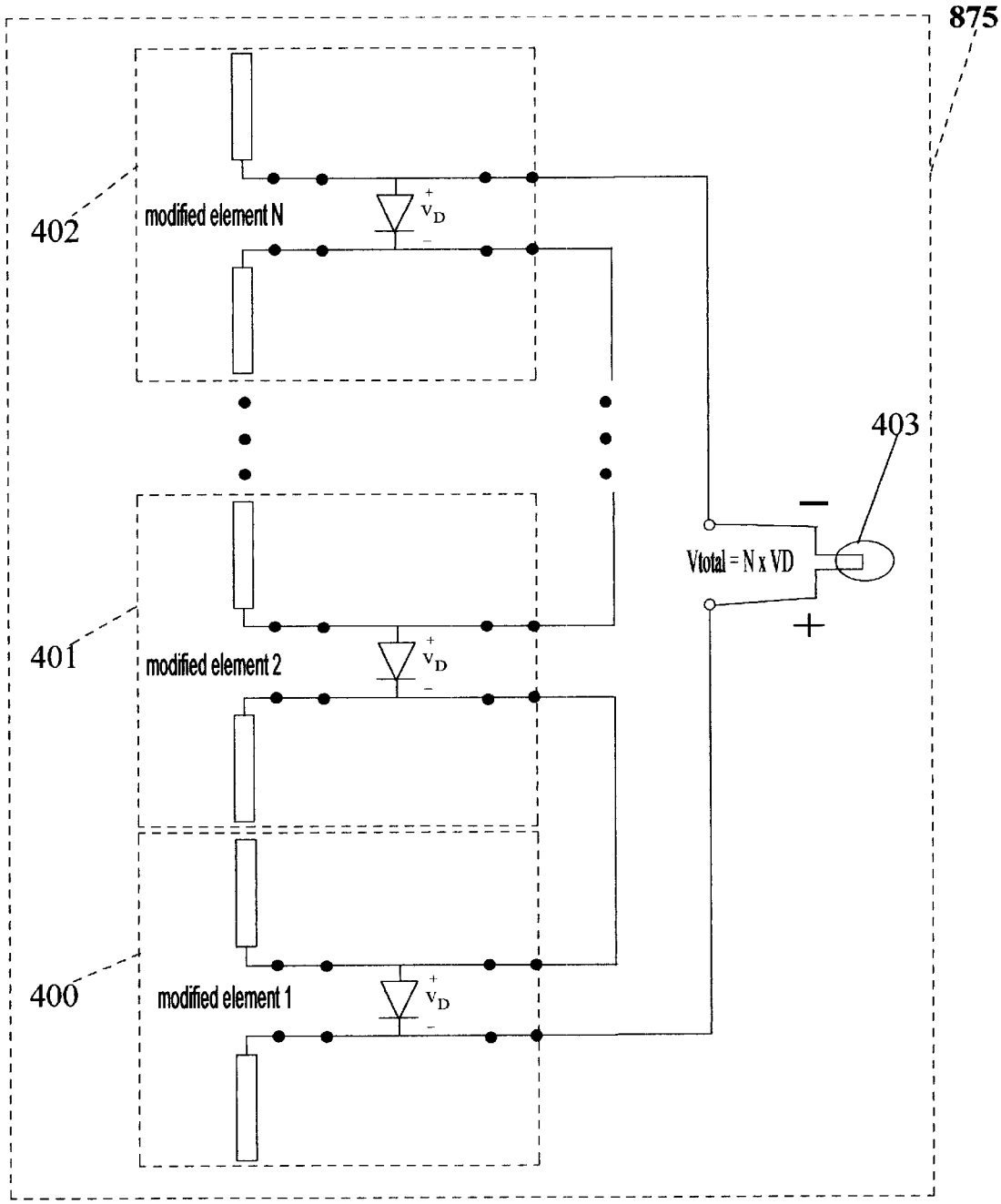
FIG. 6 is an alternative embodiment of the single-section radiation detection device in FIG. 3 used in a multiple-circuit radiation detection with advantage of providing higher detection output monitoring DC voltage levels.

In FIG. 6 is a alternative embodiment of the single-section radiation detection device 800 as shown in FIG. 3, comprising of said single-section radiation detection device 800 element in modified element 400 form to exclude the stimulus indicator means comprising of a LED device 203. Said modified element 400, forming a node detection reference point representation for the referenced dipole antenna, is employed in a multiple-series node detection configuration of dipole antennas aligned in side-by-side stacked single-section radiation detection arrangement 875 interconnected in a series mesh loop electrical connection to a alternative stimulus indicator means 403, is thereby referred to as multiple-series node detection configuration. Said multiple-series node detection configuration comprises of first said modified element 400, of second said modified element 401, of predetermined set quantity of iterative replication of modified elements, and concluding with a predetermined Nth said modified element 402, with all said modified elements electrically interconnected in predetermined series mesh loop of electrical node fashion in electrical conducting connection means to a alternative stimulus indicator means as shown in FIG. 6. The operation of said multiple-series node detection configuration is to provide means of generating greater output monitoring DC voltage signal levels as compared to that of a said single-section radiation detection device 800 when exposed to EMF energy radiation of predetermined thresholding level, and thereby appropriately driving an alternative stimulus indicator means 403 as predeterminedly requiring greater monitoring DC voltage signal drive levels.

Alternatively, said multiple-series node detection configuration with replacing said alternative stimulus indicator means 403 with a DC filtered circuit terminal output means, is thereby referred to as a modified multiple-series node detection configuration. Said modified multiple-series node detection configuration provides a means for a wireless EMF energy recovery and reuse system function to reclaim unused EMF energy radiation from a predetermined antenna main beam angle or sidelobes of the present antenna radiated emission source or electronic equipment body EMF radiated emission source, and thereby providing a supply of at least a trickle-action self-feeding-back DC power recovery charge connection means for electronic circuit devices to accept a DC power charge, is thereby also referred to as a wireless energy recovery and reuse system configuration device. Additionally note, incorporating said modified multiple-series node detection configuration with a radiation shielding device as is joined in embedding/non-embedding fashion means, alternatively provides a wireless transmit/receive electronic equipment comprising a cellular telephone or the like with a greater DC power-saving efficient operation.

Another alternative embodiment of said modified multiple-series node detection configuration is to construct it in a curtain-like net-webbing sheet form configuration comprising of predetermined electrical node fashion in elongating sheet form means to provide further means of expanded greater generating output monitoring DC voltage signal levels appropriate to drive a alternatively expanded form of stimulus indicator means.

In a preferred embodiment, referring to FIGS. 7 through 14 are perspective views of radiation shielding devices comprising a RF shielded wearable garment, RF shielded electronic equipment carrying pouch or case of upwardly fan structure, RF shielded fan structure, RF shielded wrap-around liner, RF shielded eyewear and RF shielded screens, that are joined with embedding/non-embedding fashion means of a radiation detection device where this embodiment is more simply referred to as a integrated shield detection device, is disclosed.

Whereby said integrated shield detection device assembly comprises as the subcomponents of a radiation shielding device and a radiation detection device, joined together in a predetermined fashion. For said integrated shield detection device, the said radiation detection device attachment residing coplanar and predetermined spatially located on said radiation shielding device, is generally in sandwiched-like arrangement between the predetermined sensitive human body tissue part area in need of shielding protection and the radiation shielding device effective surface area. Whereby said integrated shield detection device provides the user with continuously verifying indication means of protective shielding effectiveness measurement as performed by the radiation detection monitoring means of the device.

Said subcomponent radiation shielding devices comprises the method of EMF shielding construction and configuration to employ woven RF shielded materials that comprises of EMI/RFI (Electromagnetic Interference and Radio Frequency Interference) metallic conductive material weaved fabric and non-woven RF shielded materials that comprises of EMI/RFI material properties of metallic conductive and magnetic nature formed in sandwich layered structure or laminating process structure or EMI/RFI material property deposition structure to be joined in a structure assembly processing configuration, thereby forming hybrid fabrication constructions and processing means from that of conventional article fabrication techniques that are joined predeterminedly with EMI/RFI material properties.

Figure 7A:
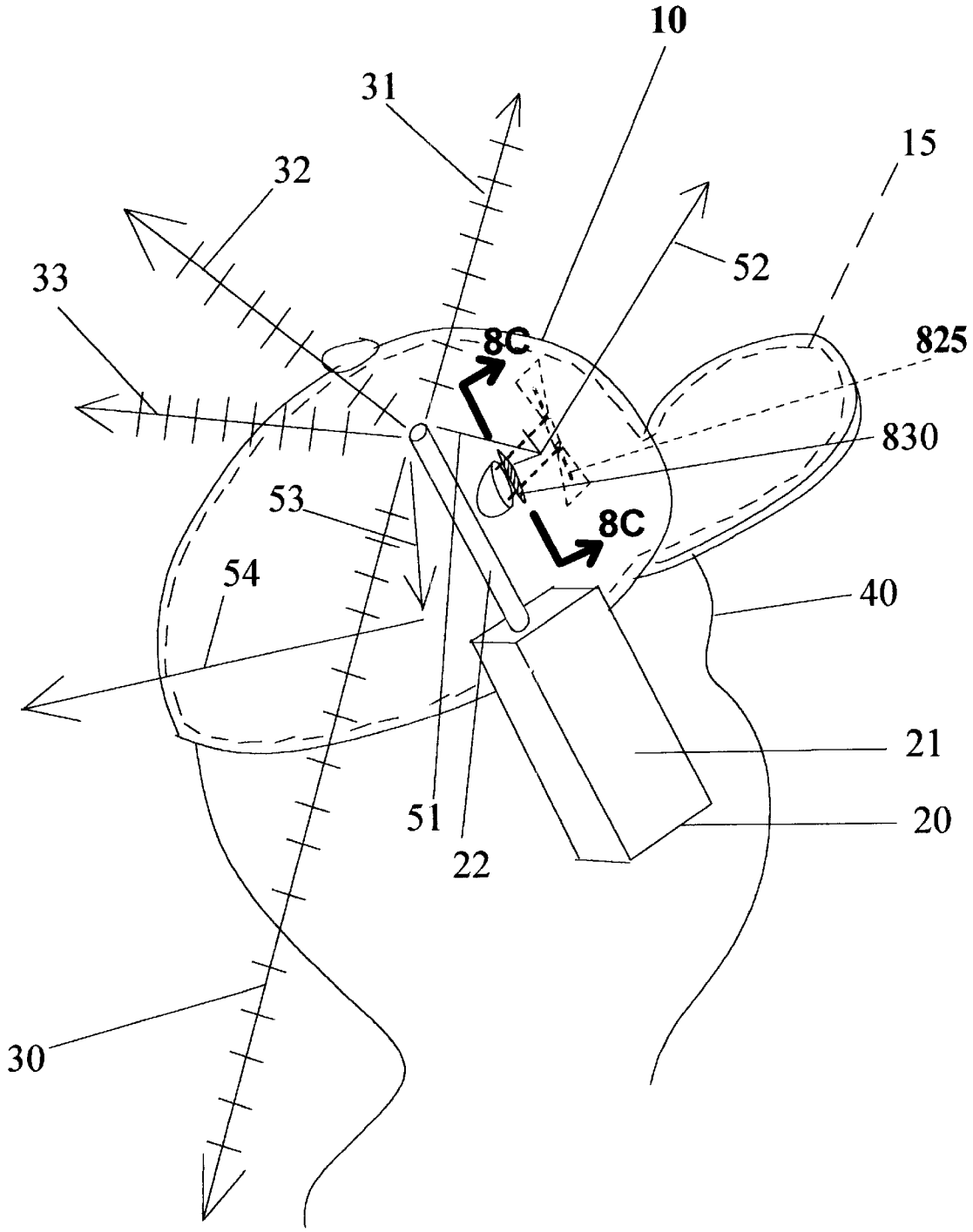
FIG. 7*a* is a perspective view of such RF shielded wearable garment device such as a RF shielded baseball cap joining with embedding/non-embedding single-section radiation detection device according to an embodiment of the present invention.

In close-proximity electromagnetic field radiation exposure to the user, the invention variation of FIG. 7*a* is a perspective view of a RF shielded wearable garment device joined in predetermined coplanar fashion means with embedding/non-embedding fashion means of a radiation detection device comprising of general construction layout using a feed-through construction attachment means 825 to employ a air vent access hole 830, is referred to as Option 7*a* of a integrated shield detection device. Said Option 7*a* is worn on the user head 40, in particular but not limited to any hat design, a RF shielded baseball cap 10 design to provide local head shield protection and shield effectiveness detection monitoring. Where said shield effectiveness detection monitoring comprising of shielding effective area 15 as is monitored by the radiation detection device for EMF energy exposure levels to direct line-of-sight EMF radiation 51,53 emanating from a wireless transmit/receive electronic equipment antenna 22.

Figure 7B:
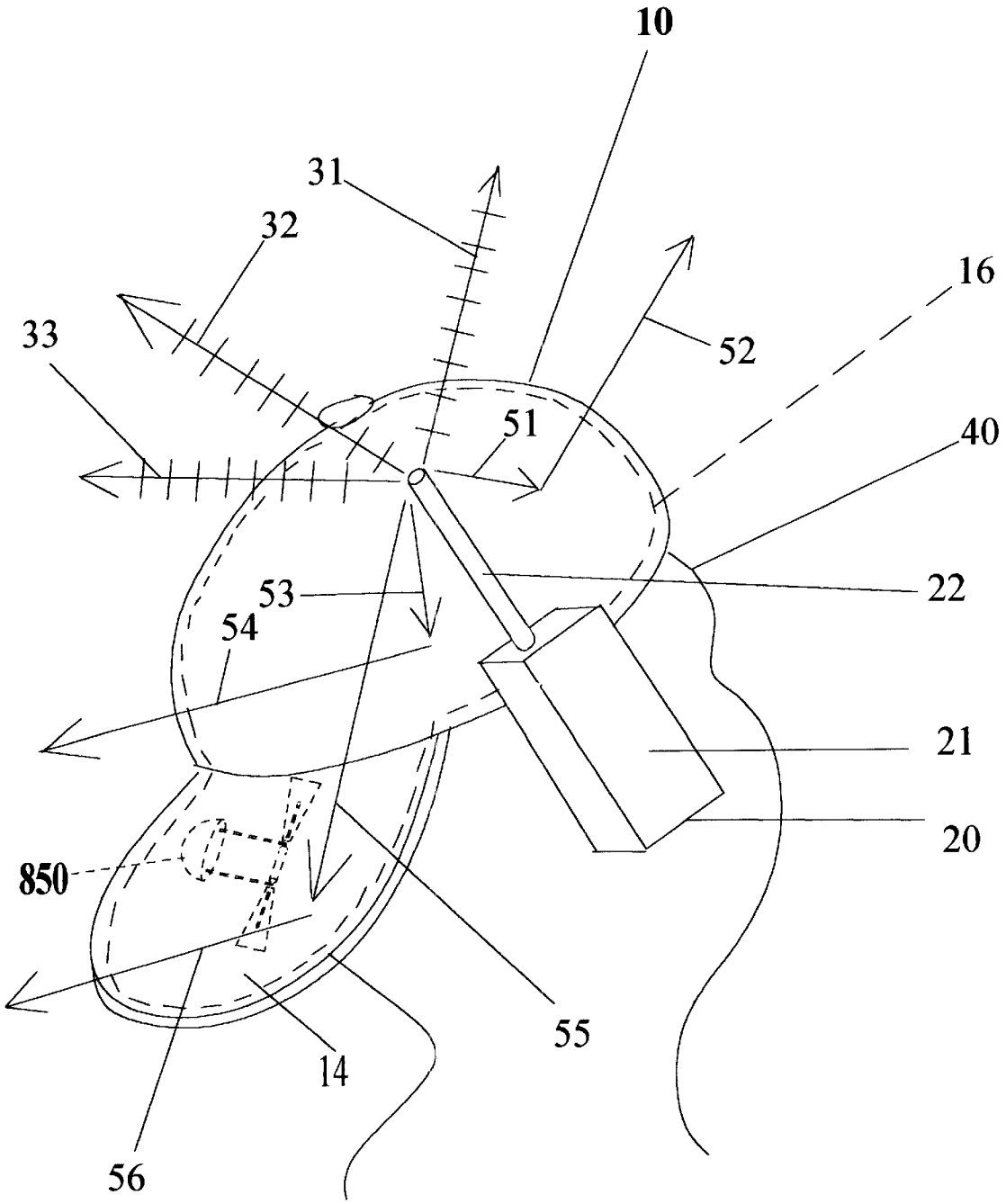
FIG. 7*b* is a perspective view of such RF shielded wearable garment device of FIG. 7*a* depicting a modified implementation of the embodiment as worn differently by the user to provide a variation in shielding and detection coverage area and shown with alternative placement arrangement of said single-section radiation detection device.

Likewise in another alternative embodiment, in FIG. 7*b* the user may wear the RF shielded baseball cap 10 design in a different manner of orientation over the head that will provide various shield protection and shield effectiveness detection monitoring, is referred to as Option 7*b* of a integrated shield detection device. Alternatively, the radiation detection device is predeterminedly located under the hat bill arrangement 14 using planar construction attachment means 850 to provide an alternative radiation detection monitoring area assess-ability for the liser. Where said shield effectiveness detection monitoring comprises of shielding effective area 16 as is monitor by the radiation detection device for EMF energy exposure levels to direct line-of-sight EMF radiation 55 at the back of the user's head emanating from said wireless transmit/receive electronic equipment antenna 22 position.

As will be disclosed, shown in FIGS. 7*a* and 7*b* according to the invention, potential harmful direct line-of-sight EMF energy radiation 51, 53, 55 are shielded or blocked by the shielding arrangement and monitored to detect for presence of leakage EMF energy through the RF shielded wearable garment by said radiation detection device.

Before continuing further with this disclosure, a note in general description is applied to FIGS. 7 to 14. The diagrammed legend 39 in FIG. 7*c* describes pictorial representations of three types of electromagnetic field radiation traveling path patterns as representative sample-point lines of directional traveling path comprising a blocked EMF radiation, a non-blocked EMF radiation and a leakage EMF radiation.

Said blocked EMF radiation is depicted as interconnecting solid lines with arrows for examples of deflected or blocked electromagnetic field radiation traveling path patterns 51 to 52, 53 to 54, 55 to 56, 57 to 58, 59 to 60, 61 to 62, 63 to 64, 65 to 66, 67 to 68 as predeterminedly influenced by the functional behavior of the radiation shielding arrangement local shielding effective area.

Said non-blocked EMF radiation is depicted as solid lines with tick marks and arrows are shown for examples of non-blocked electromagnetic field radiation traveling path patterns 30, 31, 32, 33, 34, 35, 36, 37, 38 as is predeterminedly not designed to be shielded or blocked by the radiation shielding arrangement.

Said leakage EMF radiation is depicted as dashed lines and arrows are shown for examples of leakage EMF radiation traveling path patterns 73, 74, 75, 76, 77, 78, 79, 80, 81 as representing the residual by-products of EMF radiation continuation from an original blocked EMF radiation as found incident on the radiation shielding arrangement that effectively was not totally blocked or not totally deflected or not totally absorbed or not totally attenuated by the radiation shielding arrangement.

With respect to FIGS. 7*a,* 7*b* and 7*c,* examples of shielded or blocked or deflected electromagnetic fields 51 to 52, 53 to 54, 55 to 56 and non-blocked electromagnetic fields 30, 31, 32, 33 are shown to demonstrate the ideal radiation shielding device nature by assuming that geometrical theory of diffraction (GTD) on EMF plane waves applies for the blocked or deflected and non-blocked EMF cases and thereby no further disclosure is required. But in a more practical manner, EMF energy leakage through shielding devices does exist, which cannot be excluded or discounted by GTD.

Figure 7C:
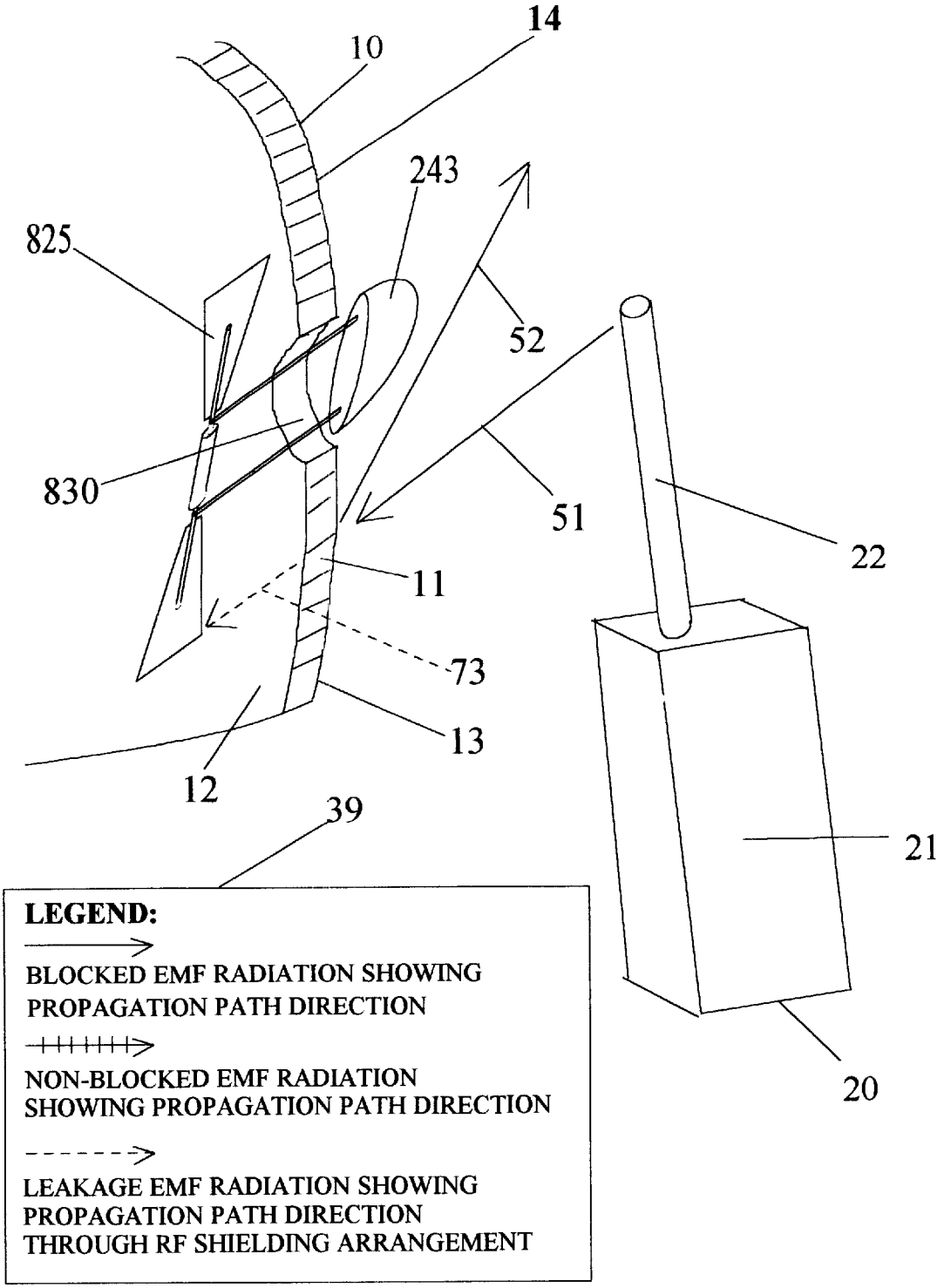
FIG. 7*c* is a perspective view cut away section of FIG. 7*a* showing single-section radiation detection device placement using feed-through construction attachment means and providing radiation detection means for shield effectiveness evaluation and assessment.

For example a leakage electromagnetic field 73 as shown in FIG. 7*c* as propagating through the radiation shielding arrangement material 11 and through the free-space originating from a point of origin EMF radiating source 51.

To calculate the relative radiation safety figure-of-merit value the user needs to perform the method of shielding effectiveness figure-of-merit measure comprising of said two test modes for detecting radiation by measurements takened without and with shielding in place at predetermined fixed separation distance thereby measurements takened constitutes performing the method of shielding effectiveness figure-of-merit measure. Where said method of shielding effectiveness figure-of-merit measure is in more simple discussion terms, is referred to as the method. Said method give results in providing a protective radiation monitoring detection ratio value in performing the ratio equating formula expression to compare the two test modes measurements takened, and displayed by said stimulus indicator means 93. Said stimulus indicator means comprising an optical transducer such as and not limited to a light emitting diode (LED) 243, an audible transducer, mechanical vibration transducer, analog metering transducer, digital metering transducer, and electrical processing transducer.

Perspectively, in general application terms example as shown in FIG. 7*c* an expanded cross-sectional cut view 14 of a radiation shielding hat comprising and not limited to the RF shielded baseball cap 10, joined with said radiation detection device of general construction layout using feed-through construction attachment means 825 and in embedding/non-embedding fashion means is residing coplanar on the inside baseball cap surface area 12 or radiation shielding side surface area 12 with its LED visible lens member part arrangement 243 extruding out to the opposing side surface area 13 from a predetermined air vent access hole 830 in the RF shielded baseball cap 10. Also recognized is, for the following disclosure on determining shield effectiveness, said radiation detection device when used to performing the said method, is predeterminedly referred to as the referenced radiation detection device.

Shown for this example in FIG. 7*c,* a normal operation of said unblocked EMF radiation is measured using said first test mode. This first sequence of operational measurement is predeterminedly performed by illuminating the referenced radiation detection device with direct line-of-sight EMF traveling path incident on the unblocked side surface 12 of the radiation shielding arrangement with a predetermined referenced EMF energy source such as and not limited to a cell phone. Said referenced EMF energy source is spatially located in un-obstructed orthogonal-sight view of the referenced radiation detection device and said referenced radiation detection device is observed for stimulus indicator means in operation such as and not limited to an LED device 243 light turning on with maximum reference light intensity level at a predetermined fixed line-of-sight offset reference distance separation. Said reference distance separation is measured between the referenced EMF energy source and referenced radiation detection device, thereby said first sequence of operational measurement constitutes a predetermined normally operating radiation detection device behavior response as is comprising the EMF strength measurement takened as to simulate a reference level without shielding in place.

Subsequently, a normal operation of said blocked EMF radiation, is measured using said second test mode. This second sequence of operational measurement is predeterminedly performed by illuminating the referenced radiation detection device with direct line-of-sight EMF traveling path incident on the blocked side surface 13 of the radiation shielding arrangement with said predetermined referenced EMF energy source is spatially located in obstructed orthogonal-sight view of the referenced radiation detection device with using the predetermined equal separation distance setting of said fixed line-of-sight offset reference distance separation but is obversely located from the referenced radiation detection device and thereby observing the stimulus indicator means in operation by an indicating minimal operation of the LED light intensity level to no light being on, whereby this minimal level operation of the LFD light intensity level to no light intensity is detected by the user, thereby said second sequence of operational measurement constitutes a predetermined normally operating RF shielded protective monitoring detection behavior response as is comprising the EMF strength measurement takened with shielding in place. Thereby, a protective radiation monitoring detection ratio value is interpreted from the calculated results for the user's assessment when the said method of shielding effectiveness figure-of-merit measure is performed.

In contrast note to a normal operation of said blocked EMF radiation, as measured using said second test mode, the prospect occurrence of a shielding material failure is characterized by an abnormal operation of said blocked EMF radiation, as measured using said second test mode. This non-typical sequence of operational measurement is also disclosed and shown in operation with stimulus indicator means to indicate an observed relatively unchanged behavior response from that of predetermined thresholding response of the originally measured said normal operation of said unblocked EMF radiation, as measured. This measurement would constitute a degree of radiation shielding arrangement functional failure and thereby an alertive warning sign is displayed for the user. In general, the foregoing test procedures characterized, is a typical operational sequence for the radiation detection verification methodology that is applicable in determining shielding effectiveness for other embodiments of integrated shield detection devices.

Also a further note in FIGS. 7*a* and 7*b* is that the shield design approach for radiation shielding coverage protection, comprising the head shielding effective area 15, 16 perspectively. Is said shield design approach of said subcomponent radiation shielding devices is to encompass around the user head 40 or to encompass other alternative objects requiring shielding protection and not to encompass around the antenna 22 or electronic equipment body 21. Thereby with said shield design approach takened, this invention design constitutes an opened-form method design solutions. Said opened-form method design solutions minimizes the impact of radiation shielding arrangement design regarding EMF side effects from causing excessive EMF signal interaction and degradation effects with the normal unblocked free space EMF signal transmission functioning of the wireless transmit/receive electronic equipment antenna design. Alternatively, other alternative subcomponent shielding devices using said shield design approach will be disclosed later. Upon further note, said open-form method design solutions will be discussed later in the specification text for added clarification.

Figure 8C:
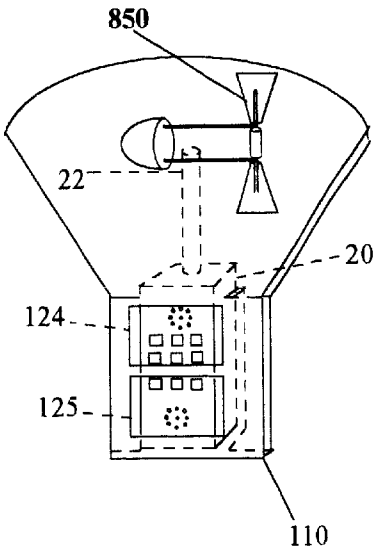
FIGS. 8*a,* 8*b* and 8*c* depicts a perspective view of such electronic equipment RF shielded carrying pouch or case of extended upwardly fan structure device joining with embedding/non-embedding single-section radiation detection device according to an embodiment of the present invention.
Figure 8B:
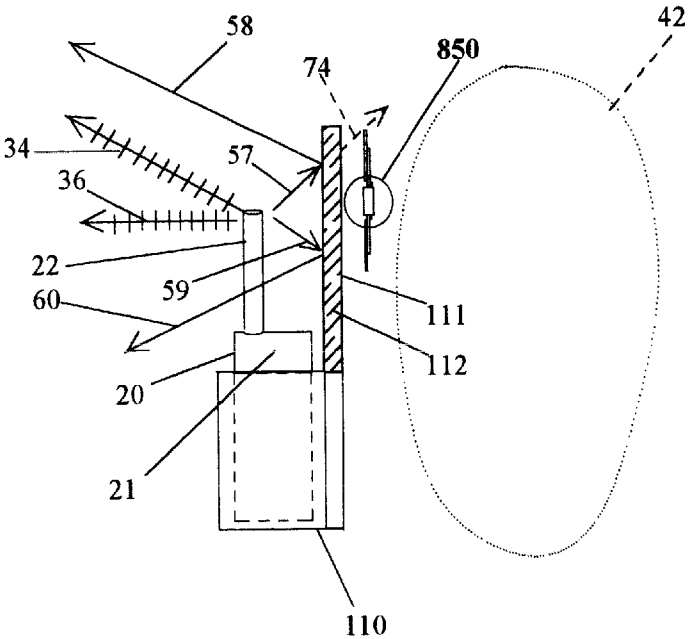
Figure 8A:
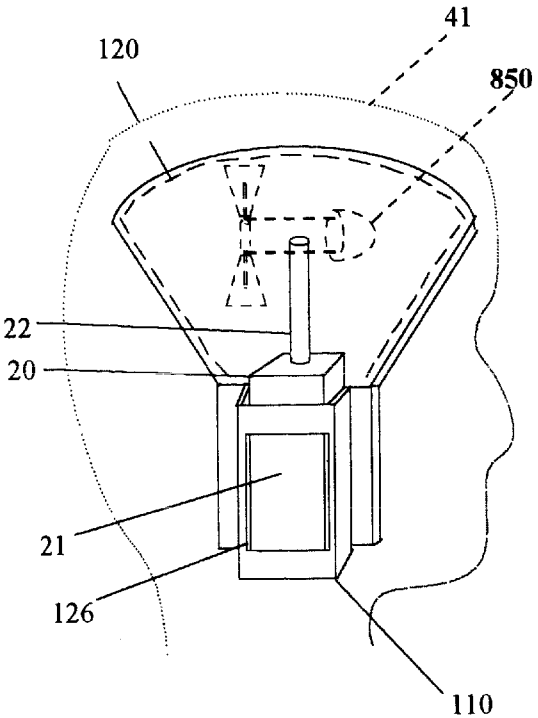

In another example of close-proximity electromagnetic field energy radiation exposure to the user, the invention variation of FIGS. 8*a,* 8*b,* and 8*c* is a back perspective view, side perspective view and front perspective view respectively, of such RF shielded electronic equipment carrying pouch or case of extended upwardly fan structure device 110 joined in predetermined coplanar fashion means with embedding/non-embedding fashion means of a radiation detection device comprising of general construction layout using planar construction attachment means 850, with electronic equipment access window holes 124, 125, 126 as required, that is hand-held by the user, near the head 41, 42, perspectively. The radiation detection device using planar construction attachment means 850 is shown in embedding/non-embedding fashion means perspective view of the radiation detection device joined with the radiation shielding device 110 that is predeterminedly located on the radiation shielding arrangement side surface 111, as is facing the user's specified region for shielding effective area 120 zone for coverage protection and radiation monitoring detection assessment. Said radiation detection device is located on the inside fan curved shield surface 111 as is located between the user's sensitive tissue body head part 41, 42 and the radiation shielding device. Where said method of shielding effectiveness figure-of-merit measure is performed, is thereby referred to simply as the method.

By that of said method, in performing EMF energy measurements using said referenced radiation detection device at predetermined spatial location points along the radiation shielding device surface to provide a measure rating for shielding or blocking effectiveness measure of energy radiated EMF is as shown by an indicating of the shielding effect on EMF energy in a reducing fashion nature comprising the radiation shielding device functional nature and radiation detection device functional nature of the integrated shield device, as these predetermined measurement steps constitutes performing the method of shielding effectiveness figure-of-merit measure and is for matter of simple discussion terms is referred to as method applied.

By said method applied with respect to monitoring the leakage EMF 74 nature as it propagates through the integrated shield detection device. This example shows of leakage EMF 74 energy radiation propagating through the radiation shielding arrangement material 112 and through free-space originating from a point of origin EMF 57 radiating source with said leakage EMF 74 energy strength measurement takened with shielding in place, in performing the ratio equating formula to compare with the originating EMF 57 energy radiating strength measurement takened previously to simulate a reference level without shielding in place, as this process constitutes performing the method of shielding effectiveness figure-of-merit measure.

The wireless transmit/receive electronic equipment 20, in particular but not limited to a cellular telephone, as this cellular telephone is predeterminedly placed inside the RF shielded electronic equipment carrying pouch or case of extended upwardly fan structure 110 to provide electromagnetic field local head shielding or blocking effective area 120 joined with the radiation detection device to provide radiation detection monitoring. Said radiation detection device is predeterminedly located on the radiation shielding arrangement side surface 111 or blocking side surface, as is facing the user's predetermined shielding effective area 120 zone for coverage protection and radiation monitoring detection assessment from the exposure to direct line-of-sight electromagnetic field energy radiation 57 to 58, 59 to 60 emanating from a wireless transmit/receive electronic equipment antenna 22 position. The remaining non-blocked electromagnetic field energy radiation 34, 36 are left to propagate un-perturbed by the invention design.

Figure 9C:
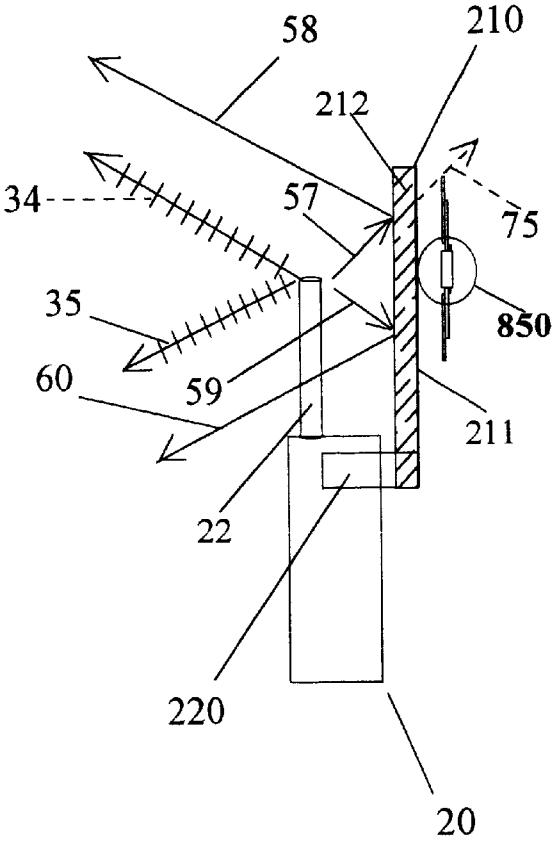
FIGS. 9*a,* 9*b* and 9*c* depicts a perspective view of such RF shielded foldable or fixed fan device structure joining with embedding/non-embedding single-section radiation detection device according to an embodiment of the present invention.
Figure 9B:
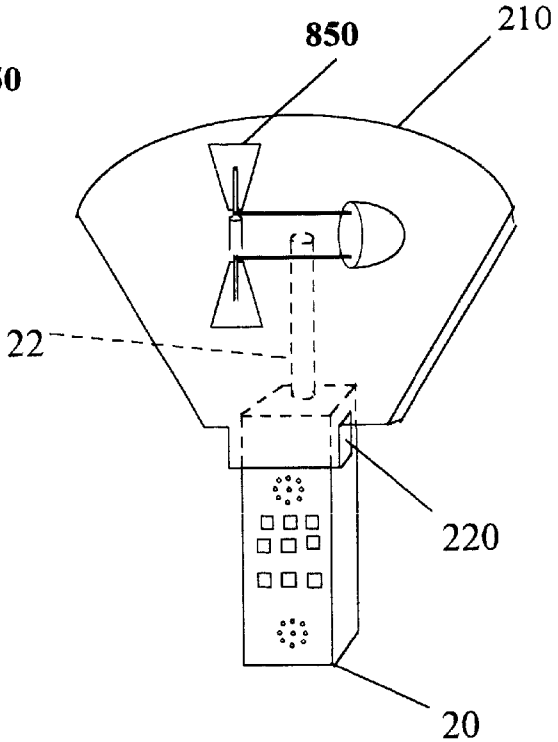
Figure 9A:
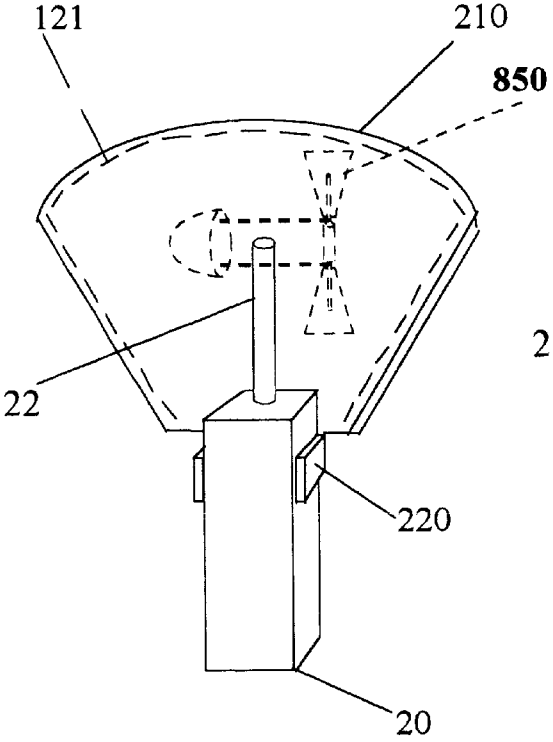

Likewise, in another example of a close-proximity electromagnetic field radiation exposure to the user, the invention variation of FIGS. 9*a,* 9*b* and 9*c,* is a back perspective view, front perspective view and side perspective view respectively, of such RF shielded foldable or fixed fan device structure 210, joined in predetermined coplanar fashion means with embedding/non-embedding fashion means of a radiation detection device and said fan device structure arrangement 210 implements a clipped-on or slip-fitted on attachment arrangement 220.

The wireless transmit/receive electronic equipment 20, is predeterminedly attached via to the clipped-on or slip-fitted on attachment structure 220. The electromagnetic field local head shielding or blocking effective area 121 joined with the radiation detection device in embedding/non-embedding fashion means comprises of general construction layout using planar construction attachment means 850 to form an integrated shield detection device. Said radiation detection device is predeterminedly located on the radiation shielding arrangement side surface 211, facing the user's predetermined shielding effective area 121 zone for coverage protection and radiation monitoring detection assessment from potential leakage EMF exposure to direct line-of-sight electromagnetic field radiation 57 to 58, 59 to 60 emanating from a wireless transmit/receive electronic equipment antenna 22 position.

By said method applied with respect to monitoring the leakage EMF 75 nature as it propagates through the integrated shield detection device. This example shows of leakage EMF 75 energy radiation propagating through the radiation shielding arrangement material 212 and through free-space originating from a point of origin EMF 57 radiating source with said leakage EMF 75 energy strength measurement takened with shielding in place, in performing the ratio equating formula to compare with the originating EMF 57 energy radiating strength measurement takened previously to simulate a reference level without shielding in place, as this process constitutes performing the method of shielding effectiveness figure-of-merit measure. The remaining non-blocked electromagnetic field energy radiation 34, 35 are left to propagate un-perturbed by invention design.

Figure 10B:
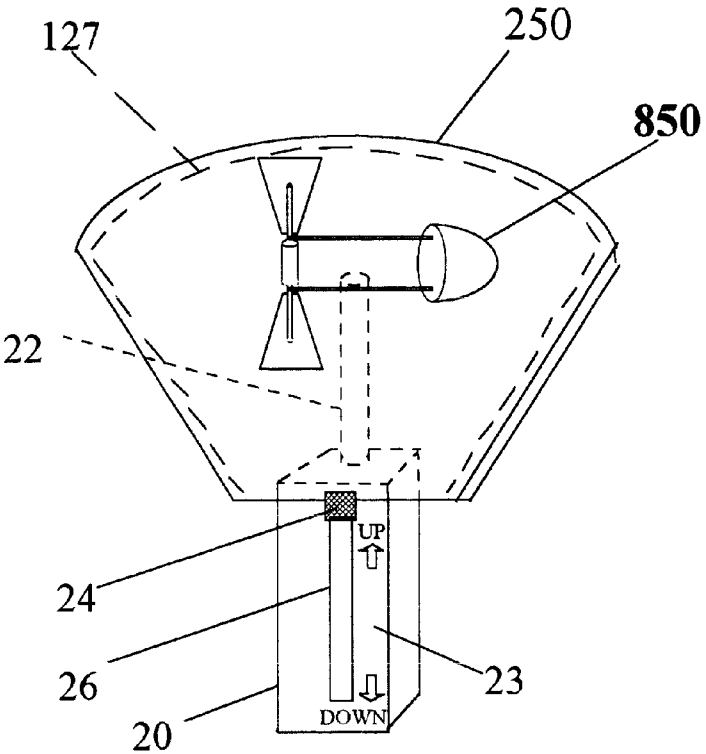
FIGS. 10*a* and 10*b* depicts a perspective view of such RF shielded internally pop-up foldable fan device structure joining with embedding/non-embedding single-section radiation detection device according to an embodiment of the present invention.
Figure 10A:
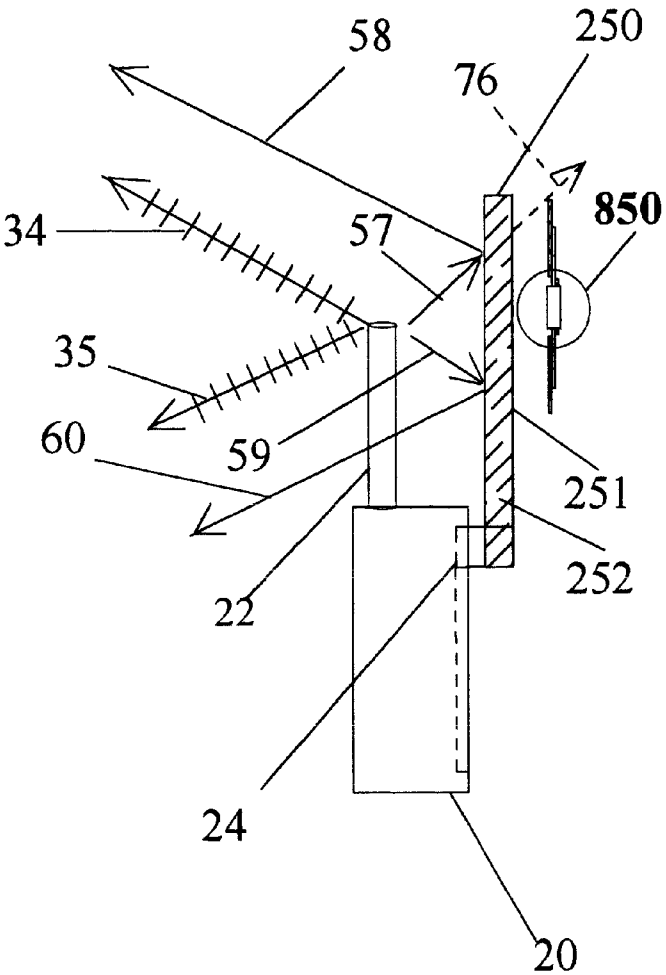

Or as shown in another variation of the invention, in FIGS. 10*a* and 10*b* of a side view and front view respectively, of a RF shielded internally pop-up fan mechanism 250 within the user wireless transmit/receive electronic equipment antenna body 23, comprising a sliding position mechanism 24 within a slide assembly 26 and thereby mechanically supports the fan device pop-up mechanism structure 250 joined in predetermined coplanar fashion means with embedding/non-embedding fashion means of a radiation detection device comprising of general construction layout using planar construction attachment means 850.

By said method applied with respect to monitoring the leakage EMF 76 nature as it propagates through the integrated shield detection device. This example shows of leakage EMF 76 energy radiation propagating through the radiation shielding arrangement material 252 and through free-space originating from a point of origin EMF 57 radiating source with said leakage EMF 76 energy strength measurement takened with shielding in place, in performing the ratio equating formula to compare with the originating EMF 57 energy radiating strength measurement takened previously to simulate a reference level without shielding in place, as this process constitutes performing the method of shielding effectiveness figure-of-merit measure.

Figure 11B:
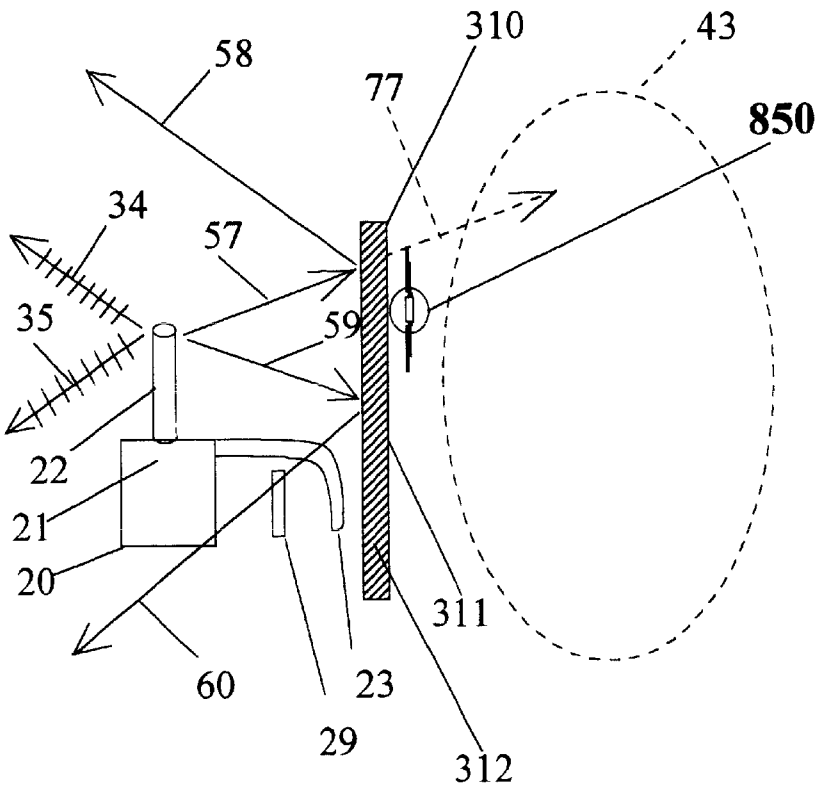
FIGS. 11*a* and 11*b* depicts a perspective view of such RF shielded sandwiched type screen device joining with embedding/non-embedding single-section radiation detection device according to an embodiment of the present invention.
Figure 11A:
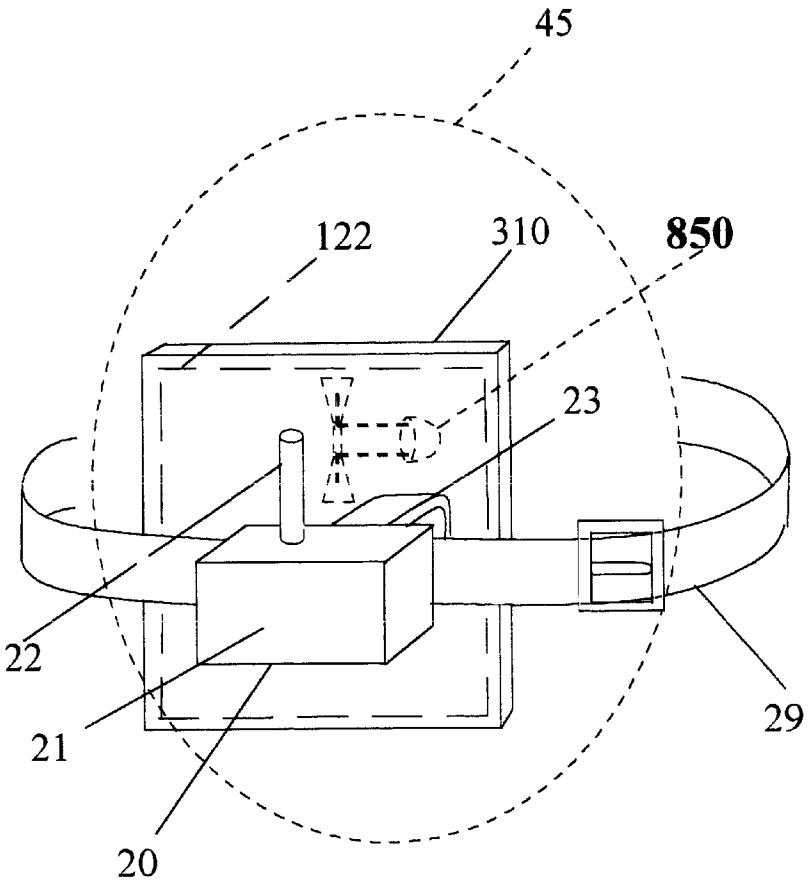

Continuing with another example of a close-proximity electromagnetic field radiation exposure to the user, the invention variation of FIGS. 11*a* and 11*b,* is a front perspective view and side perspective view respectively, of such RF shielded sandwiched type screen device arrangement 310 joined in predetermined coplanar fashion means with embedding/non-embedding fashion means of a radiation detection device comprising of general construction layout using planar construction attachment means 850. Said radiation detection device is predeterminedly located on the radiation shielding arrangement side surface 311, as is facing the user's predetermined shielding effective area 122 zone for protection coverage and radiation monitoring detection assessment, that is a slipped-in sandwich-like means between the wireless transmit/receive electronic equipment 20, a belt arrangement 29 and the user body part 43,45 perspectively for the radiation shielding device 310. The electromagnetic field user body part shielding or blocking effective area 122 is provided by RF shielded sandwiched type screen device 310 from exposure to direct line-of-sight electromagnetic field radiation 57 to 58, 59 to 60 emanating from a wireless transmit receive electronic equipment antenna 22 position.

By said method applied with respect to monitoring the leakage EMF 77 nature as it propagates through the integrated shield detection device. This example shows of leakage EMF 77 energy radiation propagating through the radiation shielding arrangement material 312 and through free-space originating from a point of origin EMF 57 radiating source with said leakage EMF 77 energy strength measurement takened with shielding in place, in performing the ratio equating formula to compare with the originating EMF 57 energy radiating strength measurement takened previously to simulate a reference level without shielding in place, as this process constitutes performing the method of shielding effectiveness figure-of-merit measure. The remaining non-blocked electromagnetic field radiation 34, 35, 36 perspectively, are left to propagate un-perturbed by the invention design.

Figure 12A:
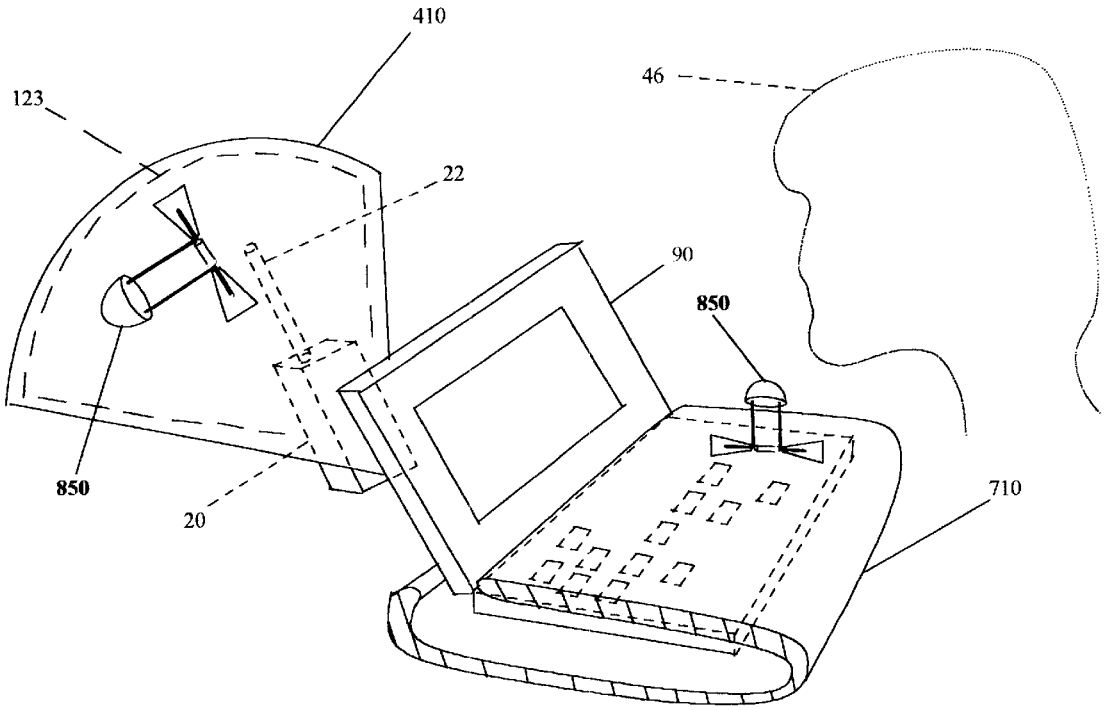
FIGS. 12*a* and 12*b* depicts a perspective view in variation of such RF shielded sandwiched type screen device joining with embedding/non-embedding single-section radiation detection device according to an embodiment of the present invention, with optional RF shielded soft-case wrap around liner arrangement joining with embedding/non-embedding single-section radiation detection device for a computer, or an alternative electrode equipment requiring human lap body part tissue arrangement protection.
Figure 12B:
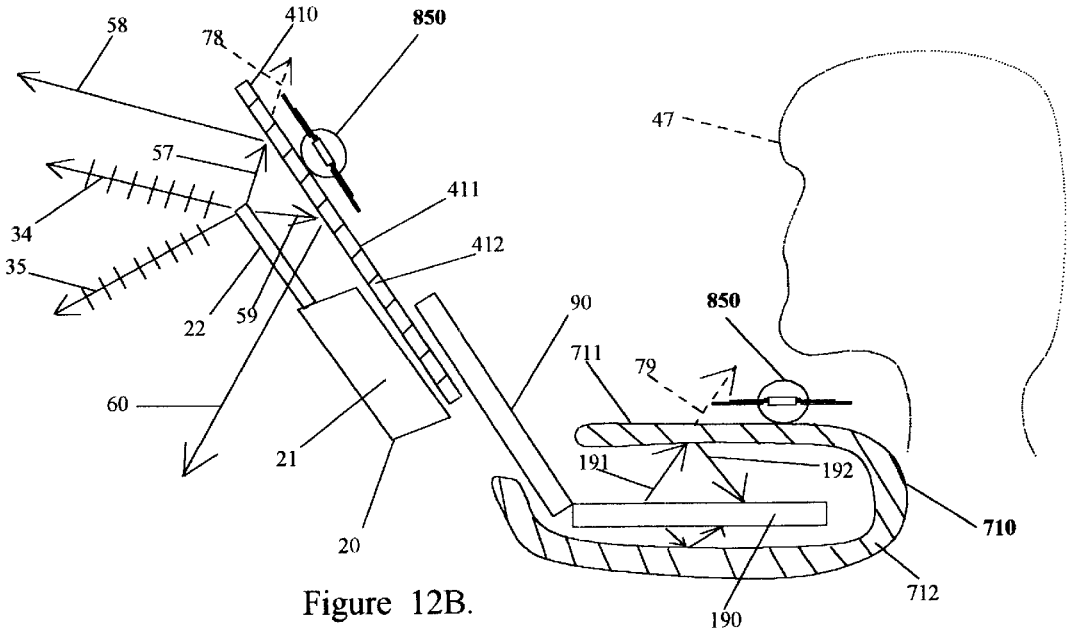

In a contrasting note, preceding discussions on invention variations were examples of close-proximity electromagnetic field radiation exposure to the user. FIG. 12 depicts this invention variation as applies to relative far-field proximity electromagnetic field radiation exposure to the user in providing effective shielding coverage protection and radiation monitoring detection. This invention variation of FIGS. 12*a* and 12*b,* is a front perspective view and side perspective view respectively, of such variation of RF shielded sandwiched type screen device 410 joined in predetermined coplanar fashion means with embedding/non-embedding fashion means of a radiation detection device comprising of general construction layout using planar construction attachment means 850. Said radiation detection device is predeterminedly located on the radiation shielding arrangement side surface 411, as is facing the user's predetermined shielding effective area 123 zone for coverage protection and radiation monitoring detection assessment that is slipped-in arrangement between the wireless transmit/receive electronic equipment antenna 22 and computer device 90 in direct line-of-sight of the human body head sensitive tissue part 46, 47, perspectively. The RF shielded sandwiched type screen device 410 is predeterminedly placed between the wireless transmit/receive electronic equipment 20, in particular but not limited to a cellular telephone, the back or front side view of the computer device 90, as to provide electromagnetic field local head shielding or blocking effective area 123 from exposure to direct line-of-sight electromagnetic field radiation 57 to 58, 59 to 60, emanating from a wireless transmit/receive electronic equipment antenna 22 position.

By said method applied with respect to monitoring the leakage EMF 78 nature as it propagates through the integrated shield detection device. This example shows of leakage EMF 78 energy radiation propagating through the radiation shielding arrangement material 412 and through free-space originating from a point of origin EMF 57 radiating source with said leakage EMF 78 energy strength measurement takened with shielding in place, in performing the ratio equating formula to compare with the originating EMF 57 energy radiating strength measurement takened previously to simulate a reference level without shielding in place, as this process constitutes performing the method of shielding effectiveness figure-of-merit measure. The remaining non-blocked electromagnetic field radiation 34, 35 are left to propagate un-perturbed by the invention design.

An alternative embodiment is further shown in FIG. 12 as an optional RF shielded soft-case wrap around liner arrangement 710 joined in predetermined coplanar fashion means with embedding/non-embedding fashion means of a radiation detection device comprising of general construction layout using planar construction attachment means 850. Said radiation detection device is predeterminedly located on the radiation shielding arrangement side surface 711, as is facing the user's predetermined shielding effective area zone for coverage protection and radiation monitoring detection assessment, for computer or electronic equipment human head or lap body part tissue arrangement protection. The RF shielded soft-case wrap around liner arrangement is predeterminedly designed to encompass the computer or electronic equipment body to envelop and shield the user from equipment body leakage EMF energy radiation. As shown in FIG. 12*b* is potentially harmful leakage EMF 79 energy radiation, emanating from a computer or electronic equipment body 190 with originating EMF 191 energy strength and the deflected energy radiation field 192 accomplished via RF shielded soft-case wrap around liner arrangement 710.

By said method applied with respect to monitoring the leakage EMF 79 nature as it propagates through the integrated shield detection device. This example shows of leakage EMF 79 energy radiation propagating through the radiation shielding arrangement material 712 and through free-space originating from a point of origin EMF 191 radiating source with said leakage EMF 79 energy strength measurement takened with shielding in place, in performing the ratio equating formula to compare with the originating EMF 191 energy radiating strength measurement takened previously to simulate a reference level without shielding in place, as this process constitutes performing the method of shielding effectiveness figure-of-merit measure.

Figure 13A:
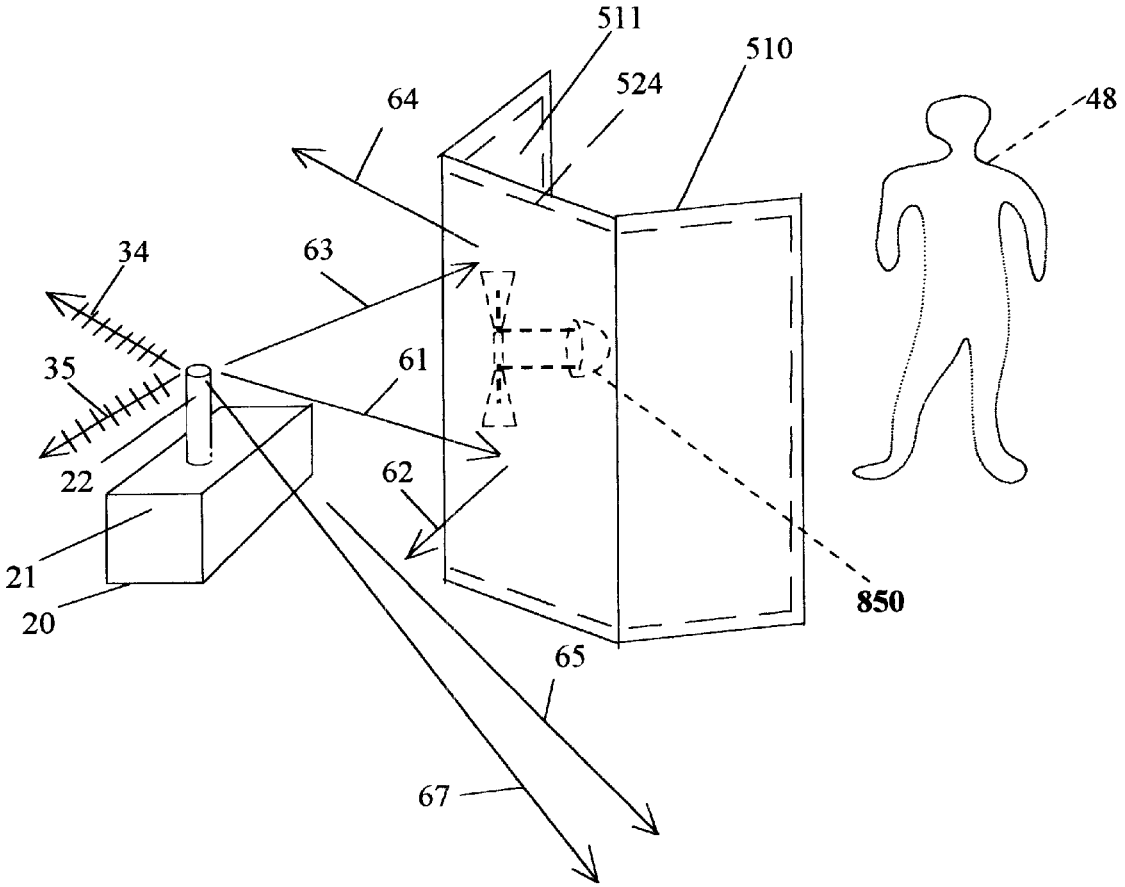
FIGS. 13*a,* 13*b* and 13*c* depicts a perspective view of such RF shielded screen or blind-screen device joining with embedding/non-embedding single-section radiation detection device according to an embodiment of the present invention.
Figures 13B, 13C:
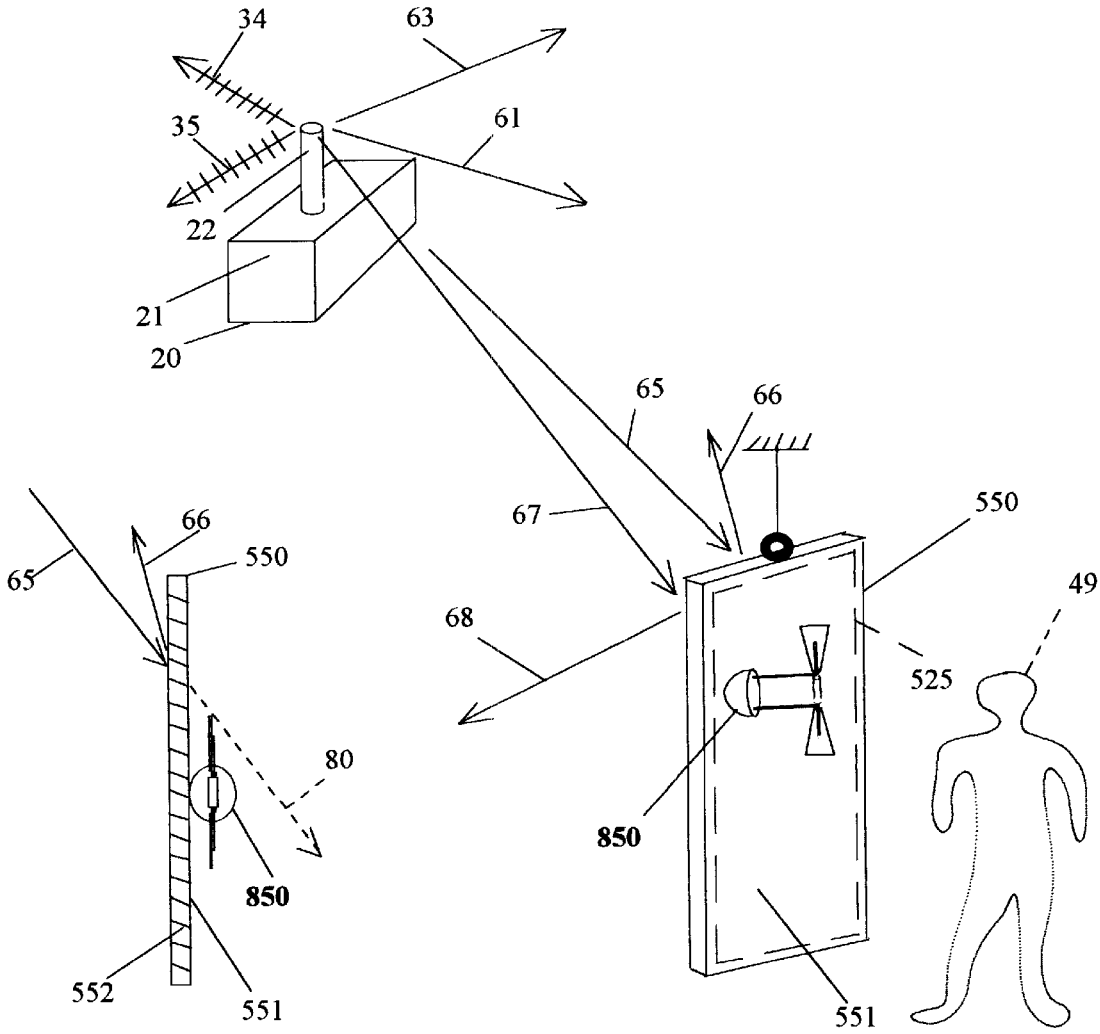

For another invention variation in relative far-field proximity electromagnetic field radiation exposure to the user as shown in FIG. 13*a,* 13*b,* and 13*c,* is a free-standing screen perspective view, suspended screen perspective view and suspended screen side view respectively, of such RF shielded screen or blind-screen device joined in predetermined coplanar fashion means with an embedding/non-embedding fashion means of a radiation detection device comprising of general construction layout using planar construction attachment means 850. Said RF shielded screen comprising of predetermined size that is either free-standing screen 510 or suspended screen 550 from a support structure and is predeterminedly placed between the wireless transmit/receive electronic equipment antenna 22 and the user human body 48, 49, perspectively. Radiation shielding is provided by the electromagnetic field shielding effective area 524, 525 perspectively, for the human body from exposure to direct line-of-sight electromagnetic field radiation 61 to 62, 63 to 64 and 65 to 66, 67 to 68 perspectively emanating from a wireless transmit/receive electronic equipment antenna 22 position.

By said method applied with respect to monitoring the leakage EME 80 nature as it propagates through the integrated shield detection device. This example shows of leakage EMF 80 energy radiation propagating through the radiation shielding arrangement material 552 and through free-space originating from a point of origin EMF 65 radiating source with said leakage EMF 80 energy strength measurement takened with shielding in place, in performing the ratio equating formula to compare with the originating EMF 65 energy radiating strength measurement takened previously to simulate a reference level without shielding in place, as this process constitutes performing the method of shielding effectiveness figure-of-merit measure. The remaining non-blocked electromagnetic field radiation 34, 35 are left to propagate un-perturbed by the invention design.

The radiation detection device placement is comprised of general construction layout using planar construction attachment means 850, predeterminedly located in coplanar fashion means on the radiation shielding arrangement side surfaces 511 and 551, as is facing the user's predetermined shielding effective area zone for coverage protection and radiation monitoring detection assessment.

Figure 14A:
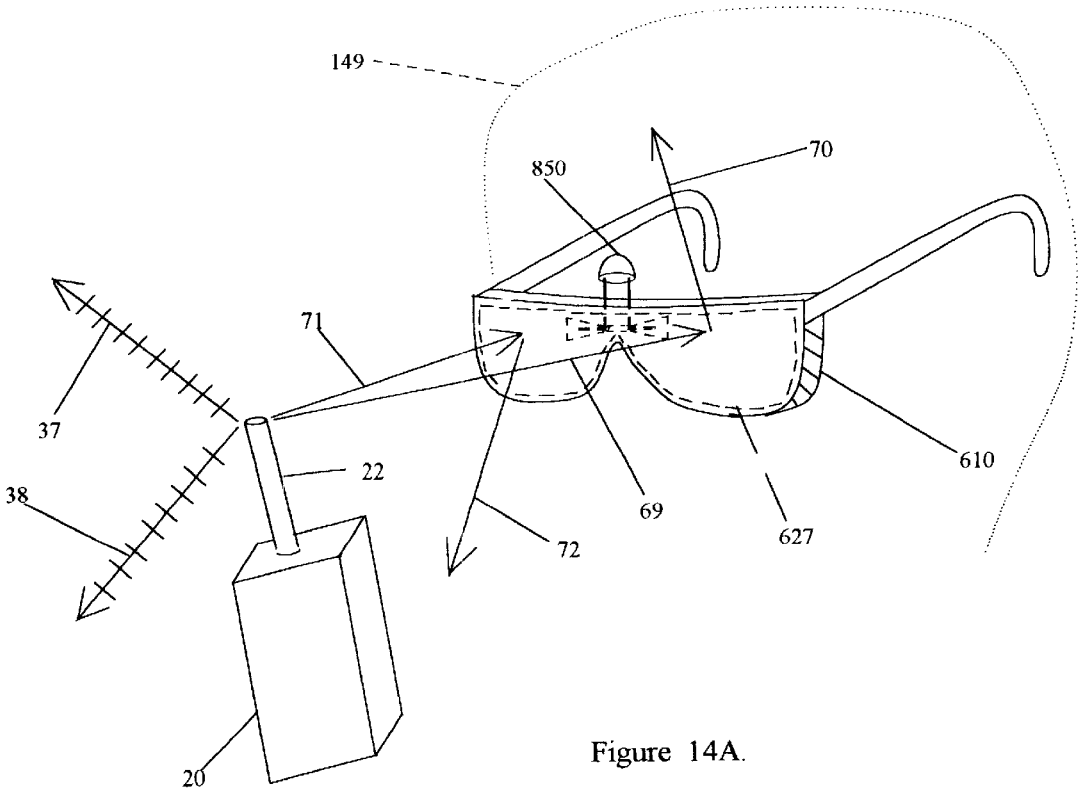
FIGS. 14*a* and 14*b* depicts a perspective view of such RF shielded eye-glass device joining with embedding/non-embedding single-section radiation detection device according to an embodiment of the present invention.
Figure 14B:
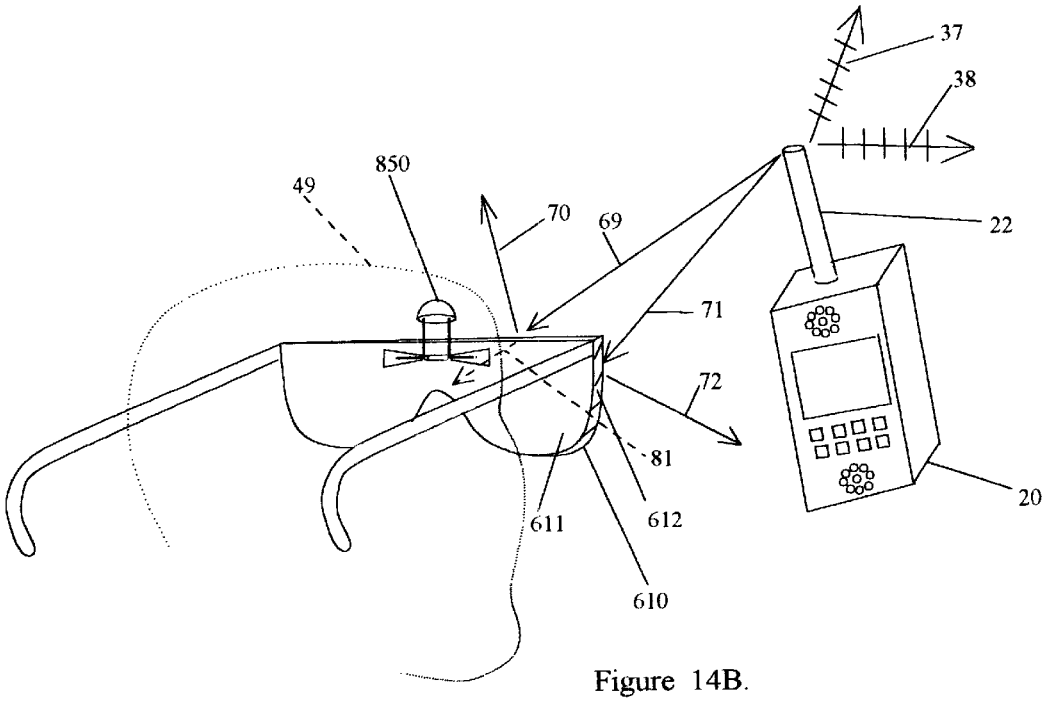

In another example of relative far-field proximity electromagnetic field radiation exposure to the user, the invention variation of FIG. 14*a* and 14*b,* is a front perspective view and back perspective view respectively, of such RF shielded eye-glass device 610 joined in predetermined coplanar fashion means with embedding/non-embedding fashion means of a radiation detection device comprising of general construction layout using planar construction attachment means 850. Said radiation detection device is predeterminedly located on the radiation shielding arrangement side surface 611, as is facing the user's predetermined shielding effective area 627 zone for coverage protection and radiation monitoring detection assessment. Said radiation detection device using planar construction attachment means 850 in embedding/non-embedding fashion means is comprising of permanently attached or not permanently attached means that will provide protective alerting means of local eye shielding or blocking effective area 627 operational capability from potentially harmful exposure to direct line-of-sight electromagnetic field radiation 69 to 70, 71 to 72 emanating from a wireless transmit/receive electronic equipment antenna 22. The remaining non-blocked electromagnetic field radiation 37, 38 are left to propagate un-perturbed by the invention design.

The wireless transmit/receive electronic equipment in this case and not limited to in function, may represent visual information content, such that the user human body head 49, 149 shown perspectively may expose sensitive human body tissue eye part to potential harmful direct line-of-sight electromagnetic fields.

By said method with respect to monitoring the leakage EMF 81 nature as it propagates through the integrated shield detection device. This example shows of leakage EMF 81 energy radiation propagating through the radiation shielding arrangement material 612 and through free-space originating from a point of origin EMF 69 radiating source with said leakage EMF 81 energy strength measurement takened with shielding in place, in performing ratio equating formula to compare with the originating EMF 69 energy radiating strength measurement takened previously to simulate a reference level without shielding in place, as this process constitutes performing the method of shielding effectiveness figure-of-merit measure. Further note that a RF shielded eye-glass device 610 comprises glass or plastic material properties.

Upon further note, regarding the integrated shield detection devices in general description applied to FIGS. 7 through 14, the subcomponent radiation detection device when joined with the subcomponent radiation shielding devices, is predeterminedly located on the shielding side surface or blocking side surface as is the surface side portion in reference to facing the user's predetermined effective area shielding zone for coverage protection and radiation monitoring assessment of shielding zone effectiveness by means for performing the method of shielding effectiveness figure-of-merit measure. Also recognized is the interchangeable nomenclature term use of subcomponent radiation detection device and radiation detection device, or subcomponent radiation shielding device and radiation shielding device, primarily to indicate the state of condition of the embedding/non-embedding configuration regarding an integrated shield detection device.

Alternatively, the said subcomponent radiation detection device in predetermined coplanar fashion means may not be restricted spatially to residing on the subcomponent radiation shielding device shielding side surface or blocking side surface. As another further alternative of the present embodiment, a pre-alerting radiation sensor detection means of EMF exposure prior to encountering a shielding function, is considered advantageous to alert the user to close-proximity exposing radiation levels before any radiation shielding protection is encountered in the ambient environment. Thereby as an alternative option, the subcomponent radiation detection device in coplanar fashion means, is alternatively placed on the opposing side of said shielding side surface or blocking side surface as to provide un-shielded EMF radiation monitoring detection of present ambient environment and is thereby referred to as a radiation sensor device.

Figure 15B:
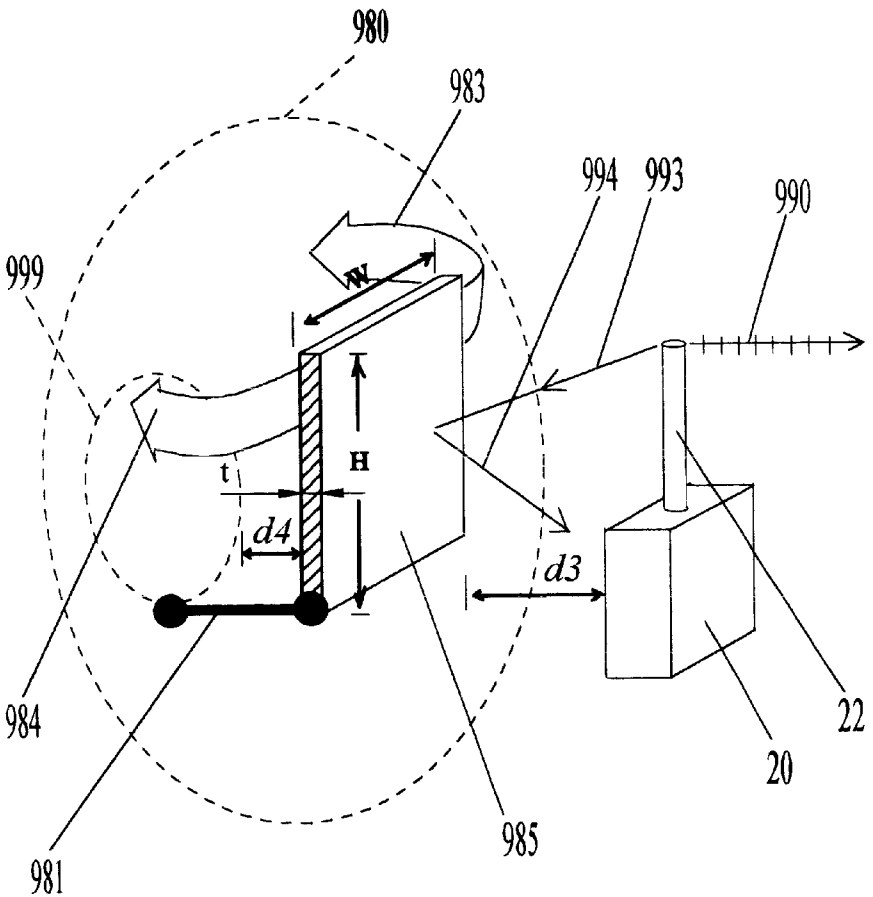
FIGS. 15*a* and 15*b* depicts a simplified circuit model comparison between a closed-form design method solutions versus opened-form design method solutions as applied to providing the user with predetermined radiation shielding from close-proximity electromagnetic field exposure.
Figure 15A:
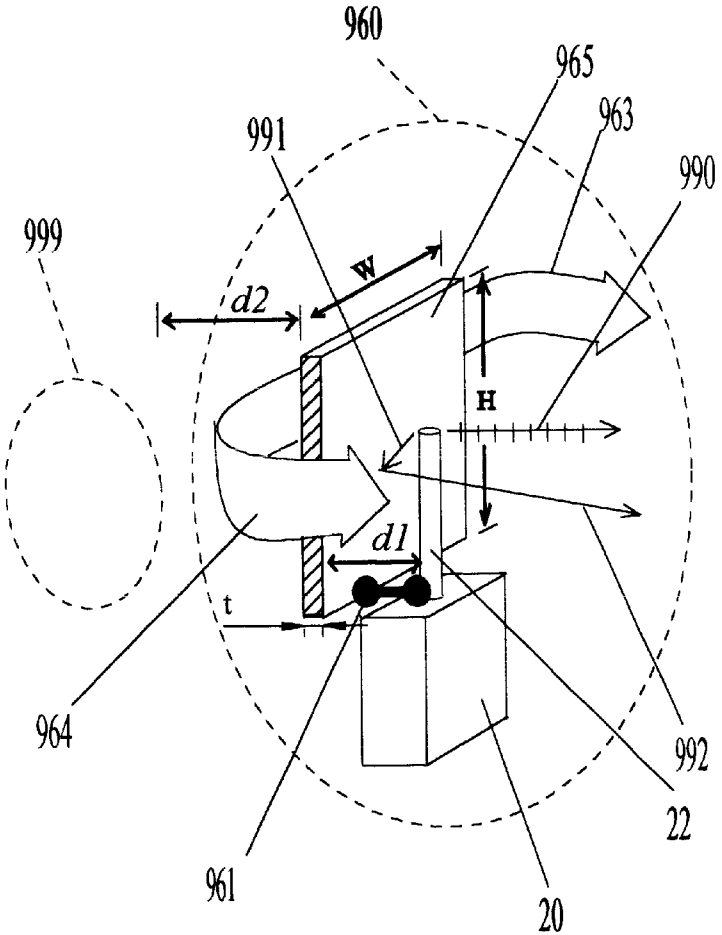

Note that for added clarification regarding the concept of closed-form method design solutions 960, a simplified circuit model is shown in FIG. 15, that shows a comparison between the closed-form method design solutions 960 versus opened-form method design solutions 980 as applied to close-proximity electromagnetic field radiation exposure to the user's predetermined human body tissue part 999. Also note that the basic distinction for the closed-form method design solutions 960 as shown in FIG. 15*a* is for the radiation shielding arrangement 965 to predeterminedly encompass in wrap-around fashion means as comprising the perspective directional view in elongated traveling path arrows 963, 964 around the electronic equipment body 21 or antenna 22 as directed along in radial circumferencing fashion with respect to the diagrammed reference node point 961 to antenna 22. In contrast, with regards to the opened-form method design solution 980 as shown in FIG. 15*b*, is the radiation shielding arrangement 985 to predeterminedly encompass in wrap-around fashion means as shown by perspective directional view in elongated traveling path arrows 983, 984 around the user's predetermined human body tissue part 999 as directed along in radial circumferencing fashion with respect to the diagrammed reference node point 981 to said user's predetermined human body tissue part 999.

An alternative embodiment to opened-form method design solutions regarding said wrap-around fashion means comprises a predeterminedly curvilinear shaped surfaces and angular stealth technology line formed surfaces as a means for minimizing EMF interactions and minimizing signal degradation to un-blocked EMF antenna radiating transmission signal in design for a predetermined shielding design parameter criterions. Likewise in concept, other alternative objects in need for shielding protection may be substituted in place for said human body tissue part 999, comprising an inanimate object-oriented sensitive devices that may require some level of degree in shielding arrangement capability.

Further note in FIG. 15, if we were to start with the same finite small closed-form surface shielding element area 965 and finite small opened-form surface shielding element area 985 comprising of a height H, width W, and thickness t, and comparingly increasing each surface shielding area 965, 985 evenly further with respect to height H and width W, according to said elongated traveling path arrows in predetermined wrap-around fashion means in perspective directional views as is directed along radial circumferencing fashion with respect to reference node points 961, 981 respectively. The closed-form shielding area 965 encompasses and terminates more electromagnetic fields from the antenna thereby increasing the EMF radiated source field 991with EMF reflected field 992 back towards the antenna location and back towards direction of remaining non-blocked EMF 990 to create EMF multiple-path interacting interference at predetermined test point location for a receiving electronic equipment, thereby increasing the antenna 22 design electrical parameter sensitivities and reflected interactions. Whereas for the opened-form shielding area 985 with increasing surface form, this change does not encompass or terminate reflected electromagnetic fields 994 back towards the antenna location appreciably to affect the antenna operation any further for matters that would be appreciated by those skilled in the art.

Prescribed within this invention employing subcomponent radiation shielding devices for said integrated shield detection devices, is an opened-form method design solution that is simply detached from the design requirement of solving for predetermined complex varying antenna electrical matching criteria parameters. Where the said subcomponent radiation shielding device using open-form method design solution now emphasizes the shielding design approach around the exposed electronic user human body tissue part, serving as means to provide an electromagnetic field radiation shielding or blocking, either reflective or absorptive or dissipative behavior in nature, in order to reduce the direct line-of-sight antenna electromagnetic field radiation to the sensitive human body tissue part without causing significant antenna signal transmit/receive interacting EMF signal degradation for proper wireless electronic equipment operation and simplifying the shielding device design, irrespective of any antenna strict electrical and structure matching criteria that would be imposed if one were to use parameters for closed-form method design solutions, thereby said shielding design approach provides simplifying the subcomponent radiation shielding device fabrication, improving performance reliability and repeatability of said integrated shield detection devices.

The discussion above describes RF shielded wearable garments, RF shielded electronic equipment carrying pouch or case, RF shielded fan structures, RF shielded eyewear and RF shielded screens, joined with embedding/non-embedding radiation detection device that include several variations to allow it operated as an electromagnetic field radiation detection and shielding or blocking device for the predetermined human body tissue part, either predetermined worn or placed in close proximity to the user. Although various implementations and variations are discussed above, other variations can be incorporated within the scope of the present invention, as would be appreciated by those skilled in the art. The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A radiation detection device employing a simple and low parts count in lightweight thin miniature construction form and generally planar with suitable embedding and non-embedding fashion means for coupling or joining in predetermined coplanar fashion means with radiation shielding devices either permanently attached or optional not permanently attached configuration, without prerequisite need for a power source, said radiation detection device comprising of functional electrical circuit block arrangements of:

an antenna means, a first conductive transmission means, a crystal detector means, a second conductive transmission means, a stimulus indicator means, and an optional auxiliary signal processing means, where said functional electrical circuit block arrangements are connected in predetermined serial electrical block node configuration or cascading block node configuration for operational means of providing protective alertive detection, verification and real-time response monitoring assessment of potential harmful electromagnetic field (EMF) energy exposure, whereby said radiation detection device design form, fit, and function does not alter or hinder the functional operation of radiation shielding devices.

2. The radiation detection device according to claim 1, the said antenna means further comprises of:

a dipole antenna, linear antenna, coil loop antenna, wire antenna, planar antenna, substrate patch antenna, multiple-quarter wavelength antenna, Yagi-type antenna, reflector antenna and array feed antenna, whereby said antenna means provides a measuring receives EMF energy radiation emanating from a wireless transmit and receive electronic equipment body and antenna energy radiating source, and transforming said EMF energy into a RF electrical signal.

3. The radiation detection device according to claim 2, wherein the said dipole antenna is comprising of:

simple dipole antenna bow-tie shaped dipole antenna, square-shaped dipole antenna, circular-loop dipole antenna, and polygon-shaped dipole antenna, whereby said dipole antenna is tuned to receive and provide measured signal of electromagnetic field (EMF) radiated emissions.

4. The radiation detection device according to claim 1, the said first conductive transmission means and said second conductive transmission means having a predetermined interconnecting electrical conductive transmission nature further comprising of:

predetermined conductive lumped element circuit lines, distributed tuned element transmission line, and hybrid circuit transmission line combination thereof, whereby the function of said first conductive transmission means and said second conductive transmission means in combination provides predetermined interconnecting electrical conductive means among various arrangements of antenna means, crystal detector means, stimulus indicator means and optional auxiliary signal processing means at respective input and output node terminal ports.

5. The radiation detection device according to claim 1, the said crystal detector means further comprises of:

a fast switching Schottky diode, diode rectifier, a transistor device, a three terminal or multiple terminal semiconductor device, and a multiple diode arrangement, whereby the function of said crystal detector means employs the square law characteristics in predetermined electrical converting means for monitoring relative power densities by accepting RF electrical signal and outputting a converted monitoring DC voltage signal and managed to operate the stimulus indicator means.

6. The radiation detection device according to claim 1, the said stimulus indicator means further comprises of:

a optical transducer including a light emitting diode, an audible transducer, mechanical vibrating transducer, an analog metering transducer, a digital metering transducer, and an electrical signal processing product transducer, whereby the function of said stimulus indicator means operates as a transducing means for converting a monitoring DC voltage signal input into a verification device indicator output form, displaying an indicator means for measurable stimulus indicator outputting translation form for the user to perform the method of shield effectiveness figure-of-merit measure.

7. The radiation detection device according to claim 1, the said optional auxiliary signal processing means having a predetermined computational transfer function nature further comprises of:

digital signal processor circuits accepting electrical signal processing product indicator inputs for internal on-board or external off-board operating fashion arrangement to provide signal outputting hookup enabled smart card device arrangement functions or bio-electronic device arrangement electrical signal functions or Bluetooth technology product functions, whereby the function of said optional auxiliary signal processing means provides an applicable electrical signal interfacing stimulus means having a interpretable digital signal transmission of data for smart card device statusing outputting means with memory processing arrangement embedded into smart card device, for bio-feedback processing means having a electrical interfacing means for embedded bio-electronic devices and for short-range radio hookup means having a electrical interfacing means for embedded Bluetooth technology product devices.

8. The radiation detection device according to claim 1, wherein said embedding and non-embedding fashion means having a method of shielding effectiveness figure-of-merit measuring means comprising of:

a predetermined radiation detection device in attachment configuration means joining with radiation shielding device either permanently attached to said radiation shielding device or optional not permanently attached to said radiation shielding device, said embedding and non-embedding fashion means provides means for ease of repeatable cycles of reliable removing process operation or reinstalling process operation of said radiation detection device from said radiation shielding device, thereby functioning as a fastening configuration means for said radiation detection device joining with said radiation shielding device by predetermined process attachment selection comprising of adhesive contacting process, sewn-on attached, by liner attached, clip-on attachment, pocket inserting means, necklace forming arrangement, jewelry forming arrangement, and Velcro-attached arrangement, with said radiation detection device joined to said radiation shielding device in a general construction layout comprising a planar construction attachment means or a feed-through construction attachment means, whereby said embedding and non-embedding fashion means provides aid to the user's own personal verification means of operational radiation detection verification measurement and performing the method of shielding effectiveness figure-of-merit measure.

9. The radiation detection device according to claim 1, is comprising of:

a single-section radiation detection device, a multiple-series node detection configuration, and a modified multiple-series node detection configuration, whereby said single-section radiation detection device, said multiple-series node detection configuration, and modified multiple-series node detection configuration, provides various radiation detecting applications for close-proximity protective alerting means from EMF radiation source exposure levels as a verification device indicator means to aid the user's own personal verification of operational RF detection verification and shielding effectiveness figure-of-merit measure from potentially harmful direct line-of-sight EMF emissions.

10. The radiation detection device according to claim 9, the said single-section radiation detection device further comprising of functional electrical circuit block arrangements of:

a predetermined simple dipole antenna to receive and provide measure of EMF energy signal predeterminedly tuned or impedance tuned to a prescribed frequency band, a first electrically conductive transmission means, a fast switching Schottky diode predeterminedly tuned impedance with junction capacitance of less than or about two picofarads, a second electrically conductive transmission means, and a light emitting diode.

11. The radiation detection device according to claim 9, the said single-section radiation detection device is further comprising of:

a balancedly tuned dipole antenna of predetermined conductive metallic strips of dipole arm member length l and dipole arm member widths w1,w2 with physical member length and member width dimensions predetermined tuned to receive and provide measure EMF energy frequency response of single EMF linear polarization for conversion into RF electrical signal, a first pair of tuned electrically conductive transmission means interconnecting electrically said balancedly tuned dipole antenna to a fast switching Schottky diode device, said fast switching Schottky diode device electrical parameters predetermined by tuning criterions for RF electrical signal conversion into a monitoring DC voltage signal to electrically drive the light emitting diode device parameters, a second pair of tuned electrically conductive transmission means interconnecting electrically said fast switching Schottky diode device to said light emitting diode device, and said light emitting diode device parameters predetermined by tuning criterions to accept being electrically driven into operation by said Schottky diode device operation.

12. The radiation detection device according to claim 9, the said single-section radiation detection device further comprises of:

a general construction layout comprising of two alternative configuration variations for said radiation detection device, in joining a radiation detection device with a radiation shielding device, said general construction layout is comprising of;

a feed-through construction attachment means with a extruding single-section radiation detection device member stimulus indicator means comprising an light emitting diode part of the single-section radiation detection device generally extruding out through a predetermined provision in a radiation shielding arrangement with feed-through access hole arrangement, and a planar construction attachment means with the single-section radiation detection device surface plane residing coplanar to the radiation shielding device surface plane, whereby the two alternative configuration variations of general construction layout provide suitable means of embedding and non-embedding form arranging as joined with radiation shielding devices.

13. The radiation detection device according to claim 12, the said single-section radiation detection device of said general construction layout having a balancedly tuned dipole antenna arrangement is further comprising of:

a predetermined pair of tuned thin tapered bow-tie shaped width conductive metallic strip of dipole arm member length l and dipole arm member widths w1, w2 antenna is predeterminedly selected as another alternative embodiment to said balancedly tuned dipole antenna with predetermined conductive metallic strips of fixed constant dipole arm member width w antenna, said bow-tie shaped width conductive metallic strip provides greater antenna EMF energy measuring efficiency, and predeterminedly attached by electrically conductive structure supporting arrangement means to fast switching Schottky diode device conductive lead assembly terminal arrangement and light emitting diode device conductive lead assembly terminal arrangement is predeterminedly attached by electrically conductive structure supporting arrangement means to said fast switching Schottky diode device conductive lead assembly terminal arrangement.

14. The radiation detection device according to claim 12, the said single-section radiation detection device further comprises of:

a general construction layout using planar construction attachment means encased in predetermined suitable material forming outer supporting structure configuration, serves as means for expanding the embedding and non-embedding configuration into a general shape embedding and non-embedding configuration, said general shape embedding and non-embedding configuration comprising a thin planar plastic laminated credit-card-size radiation detection device as specifically shaped into a credit card form as a means for greater non-embedded configuration accessibility for remote-able RF sniffing probe option device with predetermined calibration settings, forming a radiation sensor device, alternatively placing located on opposing shielding surface side, provides the user with un-shielded radiation detection device measurement capability for means of determining the early warning presence of EMF energy radiated emission and for acquiring perceptible measuring threshold presence of predetermined EMF energy radiated emissions within close-proximity of unprotected or un-shielded surrounding environment.

15. A radiation detection device according to claim 14, the said general shape encased radiation detection device is further comprising of:

a thin sheet form, a hand-held wand from, a patch-worned by the user, a patch-placed on the electric equipment, a pocket-inserting form, a shaped planar card form, shaped perforation form, shaped texture form, a shaped polygon form, a shaped cylinder form, net-like webbing sheet form, and a shaped miniature portable probing sniffer stick form, whereby alternative radiation detection devices are alternatively suitable in predetermined plastic encased forms, provides in aiding the user's own personal verification means of operational radiation detection verification measurement and ease of performing method of shielding effectiveness figure-of-merit measure.

16. The radiation detection device according to claim 9, the said multiple-series node detection configuration further comprising of:

a single-section radiation device element having a referenced dipole antenna in modified element form to exclude the stimulus indicator means comprising of a light emitting diode device, said modified element forms a node detection field reference point representation, is employed in a multiple-series node detection configuration of dipole antennas aligned in side-by-side stacked single-section radiation detection arrangement interconnected in series mesh loop electrical connection to a alternative stimulus indicator forming a multiple-series node detection configuration, is predeterminedly comprising of first said modified element form, of second said modified element form, of predetermined set quantity of iterative replication of modified element forms, and concluding with a predetermined Nth said modified element form, with all modified element forms electrically interconnected in predetermined series mesh loop of electrical node fashion in electrical conducting means to a alternative stimulus indicator means as predeterminedly requiring greater input driving signal levels, whereby the advantage of providing greater generated output monitoring DC voltage signal levels as compared to that of a said single-section radiation detection device when exposed to EMF energy radiation of predetermined thresholding level, said multiple-series node detection configuration provides alternatively greater drive levels to an alternative stimulus indicator device that predeterminedly requires greater monitoring DC voltage signal drive levels.

17. The radiation detection device according to claim 9, the said modified multiple-series node detection configuration further comprising of:

said multiple-series node detection configuration with replacing the alternative stimulus indicator means with a DC filtered circuit terminal output means, providing a means for a wireless energy reuse system function to reclaim unused EMF energy radiation from a predetermined antenna main beam angle or sidelobes of the present antenna radiated emission source or electronic equipment body EMF radiated emission source and thereby providing a supply for at least a trickle-action self-feeding-back DC power recovery charge connection means for electronic circuit devices to accept a DC power charge, thereby providing a means for a wireless EMF energy recovery and reuse system configuration device, is thereby referred to as a modified multiple-series node detection configuration.

18. The radiation detection device according to claim 9, the said modified multiple-series node detection configuration further comprises of:

said modified multiple-series node detection configuration joining in embedding and non-embedding configuration with radiation shielding devices in coplanar fashion means, alternatively providing a wireless transmit and receive electronic equipment comprising a cellular telephone or the like, with greater power-saving efficient operation with using DC power recovery charge connection means, as is provided by said modified multiple-series node detection configuration.

19. The radiation detection device according to claim 9, the said modified multiple-series node detection configuration further comprises of:

a reconstructed said modified multiple-series node detection configuration in curtain-like net-webbing form in sheet layout means comprising of predetermined node detection quantity interconnected in series mesh loop electrical connection to a alternative stimulus indicator means to provide further means of expanded greater generated output monitoring DC voltage signal levels appropriate to drive alternatively expanded forms of alternative stimulus indicator means.

20. A integrated shield detection device to provide combined functions of radiation monitoring detection means and shielding protection means from electromagnetic field (EMF) radiated emission, said integrated shield detection device is comprising of:

a subcomponent radiation detection device, and a subcomponent radiation shielding device, joined together in predetermined fashion to provide the user with overall shield effectiveness system solution for assessment means for determining radiation shielding arrangement device operational capability and functional reliability in a continuous personal monitoring mode fashion with verifying indication means of protective coverage from EMF energy exposure level intensity.

21. The integrated shield detection device according to claim 20, the said subcomponent radiation detection devices further comprising of:

a radiation detection device, and a radiation sensor device.

22. The integrated shield detection device according to claim 21, the said radiation sensor device further comprising of:

said radiation detection devices serving to provide as primary sensory circuits for said radiation sensor devices, where said radiation sensor devices alternatively placed on opposing side surface of said integrated shield detection device shielding side surface or blocking side surface as to provide un-shielded EMF radiation monitoring detection of present ambient environment by said radiation sensor device, is thereby referred to as a radiation sensor device, whereby a pre-alerting radiation sensor detection means of EMF exposure prior to encountering a shielding function, is considered advantageous to alert the user to close-proximity exposing high radiation levels before any radiation shielding protection is encountered in the ambient environment.

23. The integrated shield detection device according to claim 20, the said subcomponent radiation shielding device having a range of shielding forms further comprises of:

a radiation shielding device, a RF shielded wearable garments including hats comprising a baseball cap, a RF shielded screens including sandwiching form structure, free-standing form structure, suspending form structure, a RF shielded eyewear of glass or plastic nature including an eyeglass, a RF shielded wearable wraparound articles including a bandanna or to a scarf, a RF shielded electronic equipment carrying pouch or case of extended upwardly fan structure devices, a RF shielded foldable or fixed fan structure devices, and a RF shielded internally pop-up fan mechanism devices, whereby said subcomponent radiation shielding device, specifically worn or spatially placed between the wireless transmit/receive electronic equipment antenna or body and the sensitive human body tissue part to provide means for close-proximity protective shielding means from EMF radiation source exposure.

24. The integrated shield detection device according to claim 20, the said subcomponent radiation shielding device further comprises of:

a radiation shielding devices construction methodology to shield design approach is by employing the opened-form method design solution, where said opened-form method design solution comprises a radiation shielding arrangement to predeterminedly encompass in wrap-around fashion means as directed along in radial circumferencing fashion with respect to a predetermined body requiring shielding protection, whereby said open-form method design solutions minimizes the impact of radiation shielding arrangement design regarding EMF side effects from causing excessive EMF signal interaction and degradation effects with normal un-blocked free space EMF signal transmission functioning of wireless transmit and receive electronic equipment antenna design, more specifically in close-proximity arrangements comprising multiple transceiver signal hookup areas.

25. The integrated shield detection device according to claim 20, wherein said integrated shield detection device having a structure range of hybrid forms and having a method of shielding effectiveness figure-of-merit measuring means comprises of:

joining a radiation detection device with a radiation shielding device, joining RF shielded wearable garments including hats comprising a baseball cap with subcomponent radiation detection device to form a hybrid wearable garment integrated shield detection devices, joining RF shielded screens including sandwiching form structure, free-standing form structure, and suspending form structure, with subcomponent radiation detection device to form a hybrid screen integrated shield detection devices, joining RF shielded eyewear of glass or plastic nature including an eyeglass with subcomponent radiation detection device to form a hybrid eyewear integrated shield detection devices, joining RF shielded wearable wraparound articles including a bandanna or to a scarf with subcomponent radiation detection device to form a hybrid wearable wrap-around integrated shield detection devices, joining RF shielded electronic equipment carrying pouch or case of extended upwardly fan structure with subcomponent radiation detection device to form a hybrid electronic equipment carrying pouch or case integrated shield detection devices, joining RF shielded foldable or fixed fan structure with subcomponent radiation detection device to form a hybrid foldable or fixed fan integrated shield detection devices, joining an RF shielded internally pop-up fan mechanism with subcomponent radiation detection device to form a hybrid internally pop-up fan integrated shield detection devices, whereby said hybrid wearable garment integrated shield detection devices, said hybrid screen integrated shield detection devices, said hybrid eyewear integrated shield detection devices, said hybrid wearable wrap-around integrated shield detection devices, said hybrid electronic equipment carrying pouch or case integrated shield detection devices, said hybrid foldable or fixed fan integrated shield detection devices, said hybrid internally pop-up fan integrated shield detection devices constitutes integrated shield detection devices, specifically worn or spatially placed between the wireless transmit/receive electronic equipment antenna or body and the sensitive human body tissue part to provide means for close-proximity protective alerting means from EMF radiation source exposure as a verification device indicator means to aid the user's own personal verification of operational RF detection verification and performing method of shielding effectiveness figure-of-merit measure from potentially harmful direct line-of-sight of EMF energy.

26. The integrated shield detection device according to claim 20, wherein said subcomponent radiation shielding devices having a configuration range of fabrication techniques comprising of:

a plurality of garment fabrication techniques used to produce wearable garments including a hat arrangement comprising a baseball cap, a plurality of textile fabrication techniques used to produce wearable wrap-around articles including a bandanna or scarf, a plurality of simulated-textile fabrication techniques used to produce an electronic equipment-carrying pouch or case of extended upwardly fan structure arrangement, a plurality of eyewear fabrication techniques used to produce eyewear articles including a eyeglass of either glass or plastic material nature, a plurality of fan structure fabrication techniques used to produce attached fan structure with fixed or foldable or collapsible functions, a plurality of fan mechanism fabrication techniques used to produce internal electronic equipment pop-up fan mechanism with fixed or foldable or collapsible functions, a plurality of screen structure fabrication techniques used to produce free-standing or suspended support screen structures including blinds with fixed or foldable or collapsible functions, where said garment fabrication techniques, said textile fabrication techniques, said simulated-textile fabrication techniques, said eyewear fabrication techniques, said fan structure fabrication techniques, said fan mechanism fabrication techniques, and said screen structure fabrication techniques joined predeterminedly with electromagnetic interference and radio frequency interference (EMI/RFI) material properties of metallic conductive nature and magnetic nature to form hybrid fabrication constructions for subcomponent radiation shielding devices, comprises of:

an EMI/RFI material layer or liner joined in a predetermined about or multitude of alternating sandwich layered fashion with a predetermined wearable garment layer or support member structure layer or screen structure layer where said sandwich layers could be sewn on together, or adhesively attached or a wrapped around configuration or a temporary attachment by way of clip-on pins or pinned on attach or Velcro-attached or non-permanent bond adhesive attach or process depositioned attach together, to form together a predetermined sandwiched layer arrangement, or an EMI/RFI material layer joined with predetermined about or multitude layers of a predetermined wearable garment layer or support member layer or screen structure layer to form together a predetermined laminate arrangement, or a some about or multitude combination of predetermined EMI/RFI material types and layers used entirely in place of the wearable garment layer or the support member structure layer or the screen structure layer to form together a predetermined hybrid material arrangement, whereby a predetermined combination of said garment fabrication techniques, said textile fabrication techniques, said simulated-textile fabrication techniques, said eyewear fabrication techniques, said fan structure fabrication techniques, said fan mechanism fabrication techniques, said screen structure fabrication techniques, said predetermined sandwiched layer arrangement, said predetermined laminate arrangement, said predetermined hybrid material arrangement, provide predetermined techniques for hybrid RF shielded wearable garment fabrication construction, hybrid RF shielded eyewear fabrication construction, hybrid RF shielded fan structure fabrication construction, hybrid RF shielded pop-up fan mechanism fabrication construction, and hybrid RF shielded screen structure fabrication construction.

27. The integrated shield detection device according to claim 26, wherein said EMI/RFI material properties having a electrical design range parameters comprises of:

a plurality of predetermined EMI/RFI materials used to operate specifically within the 100 Mega-Hertz to 300 Giga-Hertz comprising the electromagnetic field frequency spectrum range parameter, a plurality of predetermined EMI/RFI materials and processes of metallic conductive nature and magnetic nature used comprising; conductive composites, magnetic composites, conductive laminates, conductive fibers, molded/extruded conductive elastomers, conductive silicone-base, conductive polymer-base, woven fabric, foam, conductive coatings, foil, tape, film shielding laminates, conductive film including Indium Tin Oxide (ITO) or multi-layer conductive coatings, conductive material deposition process, silk screen on conductive paint, metal mesh, knitted wire mesh, grilles, thereby comprising metallic conductive electrical properties having a predetermined surface resistance range and is within about zero ohms per square and less than or equal to 100,000 ohms per square comprising the electromagnetic field surface resistance range parameter, and predetermined RF skin depth metallic thickness range is within about 0.00001 inch and less than or equal to 0.03 inch comprising the electromagnetic field skin depth range parameter, a plurality of EMI/RFI materials used comprising of structure-configured forms of; conductive woven fabric, metal or polymer-based or silicone-based mesh, knitted wire mesh, grilles, of said types of forms having a multitude array of square holes in sheet-material form of predetermined thickness, where said forms design comprises a grid structure arrangement of square holes, having an overall effective square hole area design range is within about zero to 0.01 inch$^2$ in grid area effective square hole dimensions, which constitute electrical properties having predetermined electromagnetic waveguide cutoff wavelength behavior in nature comprising the electromagnetic waveguide cutoff wavelength range parameter, a plurality of predetermined EMI/RFI materials of metallic conductive nature and magnetic nature used comprising of material textures; a flat surface shape, periodic triangular-surface or accordion surface shape, periodic grid of pyramidal volume protruding element surface shape, periodic grid of semi-bubble volume protruding-in or protruding-out element surface shape, periodic grid of waffle-iron shape protruding-out or protruding-in element surface shape, which constitute the enhancement of increasing electromagnetic field surface absorption behavior in nature comprising the electromagnetic surface absorption range parameter, a plurality of implementing stealth technology methods in effectively reducing the radiation shielding arrangement device virtual radar cross-sectional foot print form-factor comprising the electromagnetic field stealth technology method range parameter, whereby said electrical design range parameters contain means for effective EMF shielding or blocking by the radiation shielding device and serves to minimize the shielding degradation effects and sensitivity interaction effects on non-blocked electromagnetic fields of normal antenna signal transmission operation.

28. A method for shielding effectiveness figure-of-merit measure using a radiation detection device to provide measure rating for shielding effectiveness of integrated shield detection devices including subcomponent radiation shielding devices and radiation shielding devices from energy radiated electromagnetic fields (EMF) at predetermined spatial location points of said radiation shielding devices, said subcomponent radiation shielding devices and said integrated shield detection device, said method comprising the steps of:

measuring a means for providing a first relative reference calibration measuring means for normal and proper radiation detection operation thereby providing EMF energy measurement takened as to simulate a reference level without shielding in place, measuring a means for providing a second relative reference calibration measuring means for indication of proper sensing by radiation detection device on the perspective blocking side of the radiation shielding device thereby providing an EMF energy measurement takened with shielding in place, performing interpretive formula expression calculation of the decibel value rating comprising the ratio equating formula of electromagnetic field strength takened without and with shielding in place, wherein the formula expression of said decibel value rating specification is alternatively restated in magnitude value rating specification for ease of the user's shielding effectiveness measure and interpretation, whereby said method provide means of close-proximity protective alerting measure from EMF radiation source exposure as a verification device indicator means to aid the user's own personal verification of operational RF detection verification and shielding effectiveness figure of merit from potentially harmful direct line-of-sight of electromagnetic fields emanating from a wireless transmit/receive electronic equipment antenna or chassis body.

29. The method for shielding effectiveness figure-of-merit measure according to claim 28, said method further comprises steps of:

applying said method to determine relative radiation safety figure-of-merit value, indicated by a graduated level indicating response means to provide perceptible presence in degrees of detected EMF energy intensity level variations measured as a function of varying the distance separated from the illuminating EMF energy source and the referenced radiation detection device.

* * * * *